US011253751B2

(12) United States Patent
Osborn et al.

(10) Patent No.: US 11,253,751 B2
(45) Date of Patent: Feb. 22, 2022

(54) APPARATUS FOR CHARGING LUMINESCENT GOLF BALLS AND AUTOMATICALLY DISBURSING

(71) Applicants: Ian L Osborn, Littleton, CO (US); Harriette L Osborn, Loveland, CO (US)

(72) Inventors: Ian L Osborn, Littleton, CO (US); Harriette L Osborn, Loveland, CO (US); James R Osborn, Loveland, CO (US)

( * ) Notice: Subject to any disclaimer, the term of this patent is extended or adjusted under 35 U.S.C. 154(b) by 0 days.

(21) Appl. No.: 16/565,072

(22) Filed: Sep. 9, 2019

(65) Prior Publication Data

US 2020/0197759 A1 Jun. 25, 2020

Related U.S. Application Data

(60) Provisional application No. 62/698,268, filed on Jul. 15, 2018, provisional application No. 62/695,212, filed on Jul. 9, 2018.

(51) Int. Cl.

| | |
|---|---|
| ***A63B 47/00*** | (2006.01) |
| ***F21V 23/04*** | (2006.01) |
| ***A63B 43/06*** | (2006.01) |
| ***A63B 43/00*** | (2006.01) |
| ***F21K 2/06*** | (2006.01) |
| ***F21V 5/00*** | (2018.01) |

(Continued)

(52) U.S. Cl.

CPC ..... *A63B 47/00* (2013.01); *A63B 43/008* (2013.01); *A63B 43/06* (2013.01); *F21K 2/06* (2013.01); *F21V 5/00* (2013.01); *F21V 23/04* (2013.01); *A63B 37/0022* (2013.01); *A63B 47/002* (2013.01); *A63B 2225/74* (2020.08); *F21Y 2115/10* (2016.08)

(58) Field of Classification Search

CPC .. F21V 33/00; F41B 11/00; F41F 7/00; A63B 69/40; A63B 69/36; F41A 19/00

See application file for complete search history.

(56) References Cited

U.S. PATENT DOCUMENTS

| | | | | |
|---|---|---|---|---|
| 3,448,985 A * | 6/1969 | Scott | A63B 57/0006 473/136 |
| 3,831,001 A * | 8/1974 | Toomey | A63B 47/005 219/386 |
| 3,937,320 A | 2/1976 | Chao | |

(Continued)

*Primary Examiner* — Eugene L Kim
*Assistant Examiner* — Christopher Glenn
(74) *Attorney, Agent, or Firm* — Malcolm Pipes

(57) ABSTRACT

A light charger charges a plurality of luminescent balls to emit light for use in dim lighting. The charger is a housing subdivided into a hopper section, a transport and light charging section, and a base section. The transport and light charging section includes a transport assembly integrated with a light charging assembly, with the transport assembly configured to receive and transport luminescent balls from the hopper into and through the light charging assembly, which comprises at least one light source. The light source comprises at least one LED and an illuminating light panel interposed between the LED and the luminescent ball when operating. The base section comprises an ejection exit point for the charged luminescent ball to exit the light charging assembly and a sensor for activating the system to eject at least one luminescent ball.

19 Claims, 26 Drawing Sheets

(51) Int. Cl.
*F21Y 115/10* (2016.01)
*A63B 37/00* (2006.01)

(56) References Cited

U.S. PATENT DOCUMENTS

| | | | | | |
|---|---|---|---|---|---|
| 3,938,132 | A | | 2/1976 | Cunningham | |
| 4,927,015 | A | * | 5/1990 | Jones | A45C 15/00 206/315.1 |
| 5,460,160 | A | * | 10/1995 | Parrott | F24V 30/00 126/263.01 |
| 5,830,034 | A | * | 11/1998 | Ciechanowski | A63H 33/22 446/219 |
| 5,998,771 | A | * | 12/1999 | Mariano | H05B 6/64 219/528 |
| 8,403,517 | B1 | * | 3/2013 | Cox | A63B 57/00 362/154 |
| 2004/0031474 | A1 | * | 2/2004 | Ciesiun | F41B 11/62 124/80 |
| 2005/0172943 | A1 | * | 8/2005 | Cucjen | A63B 69/406 124/6 |
| 2006/0042611 | A1 | * | 3/2006 | Karellas | A63B 69/002 124/16 |
| 2006/0185657 | A1 | * | 8/2006 | Gabrel | F41B 11/71 124/73 |
| 2009/0011872 | A1 | * | 1/2009 | Zhang | F41B 11/52 473/459 |
| 2011/0065520 | A1 | * | 3/2011 | Morris | A63D 15/006 473/2 |
| 2013/0104869 | A1 | * | 5/2013 | Lewis | A63B 69/40 124/78 |
| 2013/0172092 | A1 | * | 7/2013 | Choi | A63B 69/0075 473/136 |

* cited by examiner

APPARATUS FOR CHARGING LUMINESCENT GOLF BALLS AND AUTOMATICALLY DISBURSING

CROSS REFERENCE TO RELATED APPLICATIONS

This application claims priority from provisional patent application 62/695,212, filed on Jul. 9, 2018 and 62/698,268 filed Jul. 15, 2018, which are incorporated by reference herein.

BACKGROUND

The present invention relates generally to luminescent balls, and in particular, to a luminescent golf ball charging and automatic dispensing apparatus.

Photo luminescent golf balls are seeing massive increased usage on golf courses across the world. Their glow-in-the-dark ability allows golfers to golf later in the day and even into dusk and nighttime hours. Additionally, their self-luminescent qualities provide an interesting effect as the ball travels through the air, as well as providing the useful function of allowing golfers to easily find a golf ball when it lands. However, for these golf balls to operate at their peak efficiency they must be fully charged by placing them in a direct bright light. Ironically, it is the lack of this bright light as the reason why golfers are using them in the first place.

Various carriers exist for the purpose of conveniently carrying and organizing a number of golf balls. Typically, these carriers include a case having an accessible interior portion, a lid, and a carrying handle. The golf balls are either positioned horizontally or stacked vertically within the case. However, these carriers do not contemplate providing an integral light source intended to charge and activate the photoluminescent materials embedded into the cover of the golf balls.

Examples of these types of storage cases can be seen by reference to several U.S. patents.

U.S. Pat. No. 3,831,001, issued in the name of Toomey et al., discloses a golf ball heating device, which includes a closable case having a heat conductive tray for receiving golf balls and an electrical resistance heating element to heat the golf balls residing within the tray.

Various other storage containers for use with other articles also exist, as can be seen by example in U.S. Pat. No. 3,937,320, issued in the name of Chao et al., which discloses a lighted jewelry box and U.S. Pat. No. 3,938,132, issued in the name of Cunningham, which discloses an illuminated fishing tackle box.

U.S. Pat. No. 4,927,015, issued in the name of Jones, discloses luminous golf balls and a carrying case therefore which provides a light source disposed in an upper chamber of the case, a light-reflective material lining the upper chamber, and a power supply for the light source for activating the luminescent golf balls.

U.S. Pat. No. 8,403,517 issued in the name of Randy E. Cox and Randall A. Vayo discloses a recharging apparatus to contain and charge via a light source, such as an LED light source, in a vertical row orientation to activate the luminescent material in golf balls.

Some illuminating devices may be limited in the amount of golf balls that be illuminated by the device, such as a limitation of about 6 balls. U.S. Pat. No. 8,403,517 states the use of a vertical light source with a capacity of about six balls. In U.S. Pat. No. 4,927,015, a single layer of balls is disclosed having light source consisting of a fluorescent ring is also disclosed.

Each of the aforementioned inventions suffer from one or more disadvantage or deficiency with respect to design, function, or effectiveness. In particular, these devices fail to contemplate providing light for purpose of charging luminescent golf balls and dispensing for use during play. Additionally, the light provided may not be sufficient to properly charge the golf balls if used and are not easily portable for convenient transport and use during play on a course or driving range of different styles.

Accordingly, there exists a need for an apparatus by which photoluminescent golf balls can be easily and completely charged right up to the point of use and either manually, semi-automatically, or automatically ejected from the charging unit ready to be played. The development of the present invention substantially departs from the conventional solutions and in doing so fulfills this need.

SUMMARY

The present application discloses an apparatus for charging luminous golf balls and storing them for use in a fully charged state as well as automatically dispensing.

A semi-auto/full-autonomous dispensing luminescent ball charge-recharging apparatus for luminescent golf, rubber, plastic, foam balls comprising an outer housing can contain and simultaneously charge-recharge a plurality of balls and dispense them for play. The housing comprises an internal cavity, a lid, and a battery-powered or A/C-powered motor, micro-controller and internal illumination source. The illumination source is provided in rows, panels, or strips or disposed on inner surfaces of the inner cavity to provide a charging-recharging light to the balls contained inside the charging units. The illumination source preferably comprises a plurality of light-emitting diodes (LED's) positioned behind light-diffusing inner walls forming light panels. A motor-powered transport system moves balls into the charging-recharging assembly, and once balls are illuminated properly to charge luminescent balls, the motor then moves the ball to a dispensing unit/assembly to eject the ball semi-autonomously provided by a manual trigger and/or sensor system.

In some embodiments, the present inventions may provide an apparatus which charges and recharges luminescent golf balls with a high intensity light utilizing a low power consumption.

In some embodiments, the present inventions can provide an apparatus to ensure the luminescent golf balls are the brightest, or substantially the brightest, they can be up to the point of use.

In some embodiments, the present inventions may provide an apparatus which can hold at least one and up to a very large number of luminescent golf balls.

In some embodiments, the present inventions can provide an apparatus easily carried by a handle or on a golf cart or as a stand-alone unit.

In some embodiments, the present inventions can be substantially simple and intuitive to use.

In some embodiments, the present inventions can be both durable and economical to manufacture.

In some embodiments, the present inventions may include a luminescent ball charging/recharging apparatus comprising a housing. The shape of the housing may vary; in the preferred embodiments, the housing is generally cylindrical, square, or rectangular. The housing may include an openable top receiver portion for receiving luminescent balls, an upper cavity for containing the balls, an upper, middle or lower cavity for containing the functioning electrical components of the apparatus, a floor panel for separating the upper cavity and the lower cavity, and other components. The floor panel may be thin or planar, and a lid may be provided and may be attached to an upper edge of the openable top receiver portion. The lid may also be planar. A plurality of lamps can be disposed on an interior of a cavity of the charging apparatus. The plurality of lamps can provide illumination to the cavity housing. A battery pack, which may be removable or rechargeable, may be disposed within a cavity of the housing in electrical communication with the plurality of lamps for powering the plurality of lamps. In some embodiments, the luminescent ball charging/recharging apparatus may also be A/C powered.

In some embodiments, a closeable bottom portion of the housing may also include a removable battery cover for accessing the battery pack inside the housing. A switch may be disposed on an exterior of the cavity housing with an electrical communication between the plurality of lamps and the battery pack for activating the plurality of lights. The illumination provided by the lamps may be absorbed by a photoluminescent material embedded within the surface of the balls.

In some embodiments, the housing may also include a motor or microcontroller to semi-automatically or automatically move a drive shaft to actuate the movement of the balls from the holding location to the charging apparatus or charging station; an actuator or ejector may eject the balls after they have been charged so that they are ejected from the charging apparatus and into the hands of a person or onto the ground so that a golfer may play the ball.

In some embodiments, the housing may also hold a charging or power port for recharging the battery packs or for running the charger apparatus from an AC source. The charger apparatus, when in its semi-autonomous or autonomous mode, may be triggered by a communication from a photodiode sensor to the microcontroller, the communication specifying a specific function which should be performed. The photodiode may be located in a different location than the location of the microcontroller.

In at least one embodiment of the apparatus, the charge/recharging assembly may illuminate the ball by providing an inner wall portion comprised of a light-diffusing translucent material for distributing the illumination from the plurality of lamps. The plurality of lamps may be disposed behind said inner wall portion with the light diffused evenly within the apparatus onto the balls. In such a configuration, the inner wall portion is actually an illuminated light panel.

In some embodiments, a large charging apparatus may receive an uncharged ball, then charge the ball so that it illuminates, and then store the illuminated ball inside a bucket maintainer, which may include a bucket or container and a maintainer light source which may be disposed within the bucket or container and may automatically, semi-automatically, or manually with human input, turn on and provide a level of illumination so as to maintain the level of illumination for the golf ball or plurality of golf balls. In some embodiments, the amount of illumination provided by the maintainer light source may be less than the amount of illumination provided by the large charging apparatus when it charges an uncharged ball. In some embodiments, a maintainer light assembly may be disposed into a bucket or universal bucket such that a bucket without illuminating capabilities may be retrofitted so that it then has illuminating capabilities. Some of the embodiments of the invention may be used to retrofit a bucket.

In an embodiment, with a large charger, the large charger may be designed to handle a substantially large quantity of balls in bulk form due to an illuminating source which fully surrounds or substantially, fully surrounds an array of balls. This type of illuminating source and charger may provide a substantially large amount of illumination for the balls to absorb. In some embodiments, a safety off-switch communicates with a power source powering the safety-off switch. The safety-off switch may be switched into the off position by a user. By switching the safety-off switch into the off position, a user's eyes may be protected from over exposure to the light source when viewing the light source. Various systems and methods may be used to adapt an increase or decrease the number of balls that may be illuminated by an apparatus. Various systems and methods may be used to expand or decrease the ball capacity so as to adapt to the needs of different facilities. Some disclosed systems include a charging apparatus for charging the balls and a bucket maintainer assembly. As part of a system, once the balls have been charged, which may be fully-charged or substantially fully-charged, they can be taken out and put into a bucket maintainer assembly so as to cause the balls hold the illumination for play. This may allow the pre-charged balls to be used at the will of the player so that the balls are still illuminated and glowing. In some preferred embodiments, the charging apparatus may charge hundreds, thousands, or hundreds of thousands of balls while the balls are simultaneously held in the same housing or are simultaneously held in different housings.

In some embodiments, the upper plate has a plurality of chambers that are on the outer edge of the upper plate. The chambers may have an acrylic or other translucent or transparent cover with LED charging lights behind the cover. A golf ball may drop inside the chamber and be charged, and the bottom plate may have an opening that fits a ball. The positioning of the upper plate and the lower plate may be such that when a first ball drops through a first opening into a chamber, the bottom plate's opening may be spaced so that only after the bottom plate has rotated a certain amount such as 350 degrees that the opening of the bottom plate aligns with the chamber that has a ball thereby allowing the ball to pass through the bottom plate. Various configurations may be used such that there may be between one and twenty thousand chambers for charging the golf balls. Larger systems may use larger upper plates and larger lower plates such that the charging plates may be aligned around the outer edge. There may also be a second ring, a third ring, etc. of charging chambers.

In some embodiments, when the ball falls into the recharging chamber, it may sit on a plate. The ball is then tossed around inside the chamber (plate shown in FIGS. 12 and 14). Golf balls typically have a plurality of dimples on the ball, and a rough texture surface on an upper plate or the lower plate may interact with the dimples of the golf ball or parts of the golf ball surrounding the dimples so as to cause the golf ball to tumble around in the recharging chamber. In some embodiments, the first plate may lack the rough texture. A ball bump on the plate can also aid in guiding and rotating the golf ball. The plates may be 3-D printed, sandblasted, or fabricated from a mold so as to have microscopic textures.

A drive shaft can rotate plate 19 and ball bump 8 on the plate 19, which may be an upper plate or a lower plate. The bump 8 may be shaped like a pinball machine bumper and may be of various shapes which are used to interact with the golf ball so as to cause the golf ball to bounce off the bump 8.

Elements 19 and 13 may be connected by a shaft 7, and plate 19 can be a plain disk, but the ball bump 8 may be like a fixed pinball flipper or moveable flipper, such as rotatable or slidable for a short distance side to side.

Alternative charging units can be built horizontally or vertically using an auger style drive, tractor belt feed, slide gate (e.g. any means to allow 1-10+ balls at a time from a hopper (holding tank)) to enter the mechanism to move the balls from the hopper to the light charging assembly, which can be either an edge lit panel, back lit panel, strip assembly, with varying shapes—round tube square, rectangle, etc. This allows a concentrated high intensity amount of light to charge the luminescent balls. Once balls are charged, they may continue along the internal pathway to an exit point 17 for the player intended to receive the ball for play. The light charging chamber could be a simple clear cylinder with feed type auger where balls stack up in line, and that unit is set inside of the light charging housing hitting it with massive light providing the illumination needed for charging the luminescent balls, which the unit then ejects out to player.

Based upon the design of the transfer mechanism, the unit can be made for a single (personal use or large groups) machine to a double or even multi-unit (large volume) machine either having the ability to have a dual power source be it an AC or DC power source.

Auto vs Semi Auto: A computer driven algorithm on the micro controller can control the unit to move the balls from a starting position thru the whole assembly to finally discharge to the player. The microcontroller can eject balls at variable time intervals, set time intervals, or a single time event (allows for timed competitions or just standard play). The unit can also be configured to charge a set number of balls for payed events requiring time or quantity played.

Semi-auto can also allow for a person to have a smaller machine that charges a ball and takes a players action to move the said ball from the start point to the output point for play of the illuminated ball. This allows the ability to have units located in various locations (attached to golf carts, table top, local field play, etc.).

Dual Power capabilities: Allows stationary or remote location positioning of the machine.

Size of the machine can vary based upon the charging requirements, which could range from four to several thousand depending on the size of a supply hopper and the number of internal light charging units.

In some embodiments, a light charging system for charging a plurality of luminescent objects to cause said objects to emit light, comprises a housing subdivided into a hopper section, a transport and light charging section, and a base section; the housing further comprises a lid assembly for sealing the hopper and providing a light proof enclosure; the transport and light charging section further comprises a transport assembly integrated with a light charging assembly, with the transport assembly configured to receive and transport at least one luminescent object from the hopper into and through the light charging assembly, which comprises a lighting source; the lighting source comprising an illuminating light panel interposed between at least one light source and the at least one luminescent object when operating; and the base section comprises an ejection exit point for and the at least one luminescent object to exit the light charging assembly and a sensor for activating the system to eject at least one luminescent object.

In some embodiments, an apparatus for light charging a plurality of luminescent balls to cause said balls to emit light comprises a hopper section for receiving and storing a plurality of luminescent balls, a luminescent ball transport and light charging section, and a base section, with each section light proofed to prevent light leakage; the luminescent ball transport and light charging section further comprises a transport assembly integrated with a light charging assembly, with the transport assembly configured to receive and transport at least one luminescent ball from the hopper into and through the light charging assembly, which comprises at least one light panel interposed between at least one light source and the at least one luminescent ball; and the base section comprises at least one signal input device to control an ejection exit point to cause at least one luminescent ball to exit the light charging assembly.

In some embodiments, a method for charging a luminescent ball, comprises the steps of providing a section for receiving and storing a luminescent ball, a luminescent ball transport and light charging section, and an ejection section; transporting the luminescent ball using a transport assembly integrated with a light charging assembly, with the transport assembly configured to receive and transport the luminescent ball from the hopper into and through the light charging assembly, which comprises a light source, and into the ejection section; ejecting a luminescent ball once light charged from the ejection section; and controlling the luminescent ball transport and light charging section and ejection section using a micro control and sensor electric circuit to implement at least one of the following modes of operation— a. automatic whereby the system functions to eject luminescent balls at preset time intervals;

b. automatic whereby the system functions to eject a set number of luminescent balls at a single time or over a set time period;

c. semi-automatic whereby the system functions to eject a set number of luminescent balls in response to a sensor input; and d. semi-automatic whereby the system functions to eject one luminescent ball at a single time or over a set time period in response to a sensor input.

Descriptive key for the various embodiments of the charging apparatus described herein in FIGS. 1-26.

1 Housing (size expandable/with or without decorative trim or other elements in wood, metal, or plastic.)
2 Fill opening.
3 Hopper trays for ball access
4 Motors for drive actions.
5 Electronics housing.
6 Guide stops for varying angle ejection plate.
7 Drive shafts.
8 Ball bump.
9 Light sources.
10 Rechargeable/replaceable battery pack.
11 Luminescent light chamber mounting guides.
12 Clear luminescent light chambers.
13 Luminescent light chamber mounting plate.
14 Lower guide ball friction plate.
15 Retaining stops for luminescent plates.
16 On/off switch.
17 Ball ejection exit point.
18 AC/DC converters.
19 Upper guide ball injection plate.
20 Luminescent charging assemblies.
21 Power transformers.
22 Power port for charging or constant power.

23 Trigger sensors for motor control of semi/auto function.
24 Terminal strips.
25 Motor control switches for semi-auto/auto functions.
26 Microcontroller for motor/automation control.
27 Handle brackets for carry handle/handle.
28 Duplex outlets.
29 Power cord.
30 Illuminations (light rays).
31 Adjustable angle ejection plates.
32 Lid assemblies.
33 Fill opening cover.
34 Transformer plug.
35 Augers.
36 Luminescent balls.
37 Clear tractor belt assemblies.
38 Base equipment holding base.
39 Wiring.
40 Electronics bay.
41 Recessed indentation for light source/light trap panel.
42 Stepped indents to provide snap fit for universal bucket sizes.
43 Universal size buckets (generic 3-5 gal etc.).
44 Custom light trap materials (brush, foam, rubber, etc. . . . )
45 Locking non-locking caster wheels.
46 Hinges for lid assembly.
47 Stop block assembly for holding lid assembly open.
48 Stop block arms assembly for lid.
49 Holding ring tabs for light source and protection panels.
50 Electrical wirings protection assembly for lid assembly.
51 Locking nut assembly for holding lid open.
52 Pivot able screw assembly for lid holding assembly.
53 Stop block assembly holding station.
54 Protection panels for light sources.
55 Universal vacuum formed glow ball maintainer lid assembly.
56 Plate ejection portal.
57 Auger tube.
58 Belt-feed.
59 Vertical paddles.
100 Lower second housing.

Further novel features and other objects of the present invention will become apparent from the following detailed description and discussion.

The disclosed innovations, in various embodiments, provide one or more of at least the following advantages. However, not all of these advantages result from every one of the innovations disclosed, and this list of advantages does not limit the various claimed inventions.

Increased ease for charging luminescent objects.
Light coverage for an object's entire surface.
Scalability.
Portability.
Energy efficiency.

BRIEF DESCRIPTION OF THE DRAWINGS

The disclosed inventions will be described with reference to the accompanying drawings, which show important sample embodiments of the invention and which are incorporated in the specification hereof by reference, wherein:

FIG. 16 depicts further details of an embodiment of clear luminescent charging assembly 20 such as depicted in FIG. 12, according to a preferred embodiment of the present inventions;

DETAILED DESCRIPTION OF SAMPLE EMBODIMENTS

Figure 1:
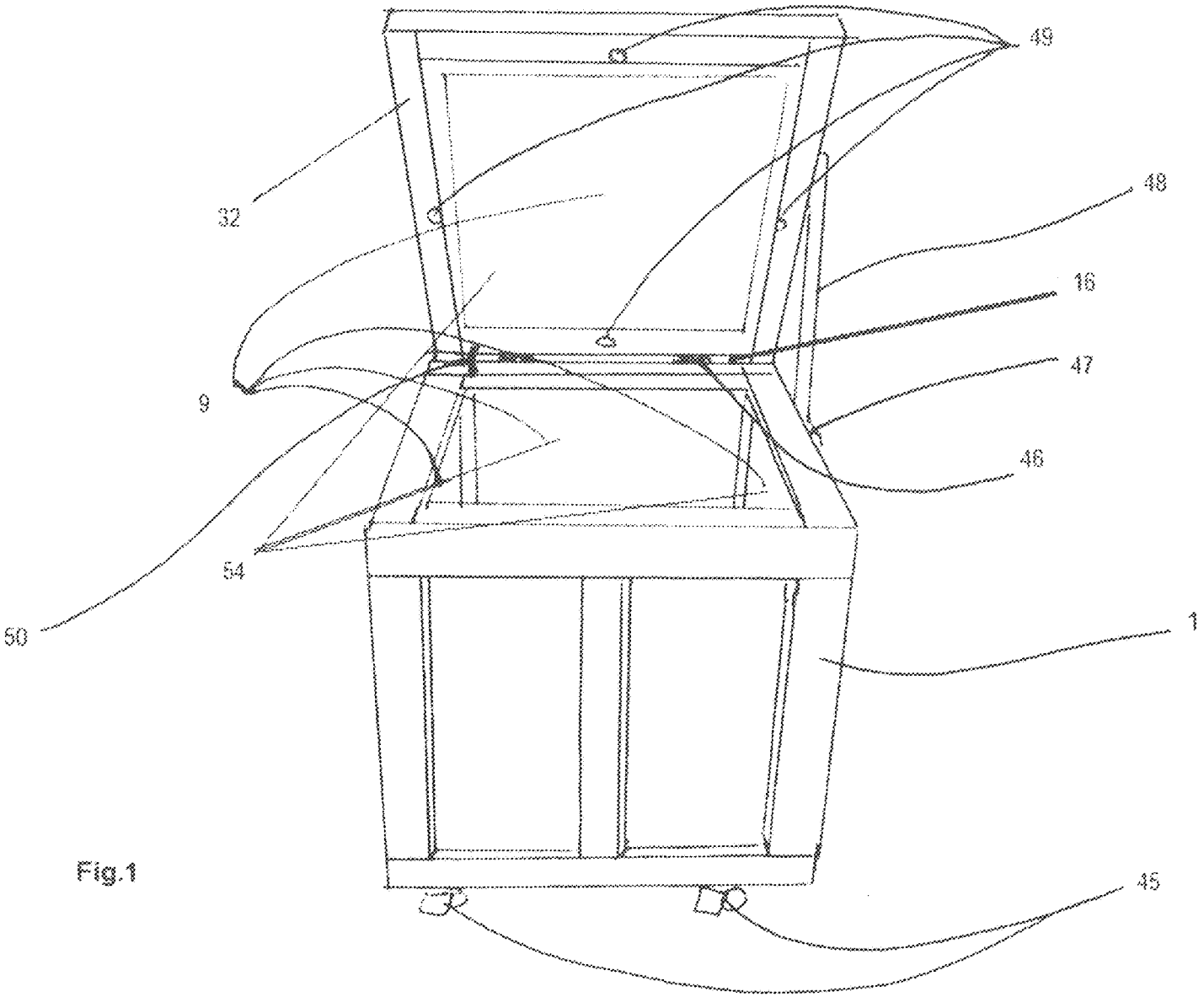
FIG. 1 depicts a super charger unit or charging box providing a bulk holder for luminescence charging of a large number of luminescent balls, according to a preferred embodiment of the present inventions.

The numerous innovative teachings of the present application will be described with particular reference to presently preferred embodiments (by way of example, and not of limitation). The present application describes several inventions, and none of the statements below should be taken as limiting the claims generally.

In the following discussion, numerous specific details are set forth to provide a thorough understanding of the present disclosure. However, those skilled in the art will appreciate that embodiments may be practiced without such specific details. Furthermore, lists and/or examples are often provided and should be interpreted as exemplary only and in no way limiting embodiments to only those examples.

Exemplary embodiments are described below in the accompanying Figures. The following detailed description provides a comprehensive review of the drawing Figures in order to provide a thorough understanding of, and an enabling description for, these embodiments. One having ordinary skill in the art will understand that in some cases well-known structures and functions have not been shown or described in detail to avoid unnecessarily obscuring the description of the embodiments.

In a first embodiment of a charging apparatus, the charging apparatus may be semi-automatic, manual, or fully-autonomous. The charging apparatus may be used to charge or a recharge an object, such as a ball, to impart luminescence to the object. A semi-automatic or fully autonomous dispensing luminescent ball charge-recharging apparatus for luminescent golf, rubber, plastic, or foam balls can comprise an outer housing capable of containing and simultaneously charging-recharging a plurality of balls and dispensing them for play.

The housing can preferably comprise an internal cavity, a lid, and a battery-powered or A/C-powered motor, micro-controller, and internal illumination source. The illumination source is provided in rows, panels, or strips disposed on inner surfaces of the inner cavity to provide a charging-recharging light to the balls or other objects contained within. The illumination source preferably comprises a plurality of light-emitting diodes (LED's) positioned behind light-diffusing inner walls forming a light panel. The motor-powered transport system may move balls into the charging-recharging assembly, and once balls have been properly illuminated, the light charging assembly may then be configured for a dispensing function and eject the ball manually/semi-automatically, semi-autonomously, autonomously, or automatically as provided by a trigger or sensor system or a micro-controller.

A second embodiment of a charging apparatus may be referred to as a luminescing lid assembly and can be used in a light box charging unit or a light charging pail or bucket, and such an embodiment can be used to light charge a luminescent object or maintain the light charge of a luminescent object. A luminescing lid assembly for charging golf, rubber, plastic, or foam balls having luminescent capabilities can use a lid assembly comprising an outer housing capable of being snapped onto a bucket, thereby converting a bucket into a bucket maintainer or light charging assembly. A bucket maintainer may be formed by coupling a luminescing lid assembly to a more or less conventional bucket. In preferred embodiments or methods, balls having luminescing capabilities are charged within a charging apparatus or large charging apparatus and then transferred into a bucket maintainer having a luminescing lid assembly. The luminescing lid assembly may then emit light upon bails having luminescing capabilities and which have been disposed inside the bucket, thereby allowing charged balls to maintain a higher level of luminescence than if the balls were charged and then disposed in a generic bucket that does not emit light.

The housing may comprise an internally formed cavity for holding the electronics that power the light source, such as an LED light source. The assembly may have a plurality of integrated ribs allowing the lid assembly to be coupled to buckets of different sizes. The luminescing lid assembly may have a light trap configured to substantially hold the illumination inside the cavity by a flexible material. The light trap may be configured to allow a user to insert a hand through the light trap and into the unit to extract a ball, while the light trap may also be configured to substantially close the gap between a user's hand and the light trap, thereby reducing the amount of light that escapes from the bucket maintainer. The luminescing lid assembly may be plugged into a wall A/C source or the luminescing lid assembly may be powered by batteries, such as single use or rechargeable batteries.

A third embodiment of a charging apparatus can be referred to as a large charging apparatus. A large charging apparatus may be a luminescent ball charge-recharging apparatus for luminescent golf, rubber, plastic, or foam balls. The large charging apparatus may comprise a housing capable of containing and charging-recharging a plurality of balls. The housing may comprise an internal cavity, a lid, and an internal illumination source. The illumination source may be provided via an extremely high intensity light panel. The illumination source preferably comprises a plurality of light-emitting diodes (LED's) positioned behind light-diffusing inner walls for protection against elements and damage. The large charging apparatus may be coupled to caster wheels to provide increased maneuverability and portability.

FIG. 1 depicts a super charger unit or charging box providing a bulk holder for a large number of luminescent balls (i.e., a light box). A housing 1 with a bottom and four walls essentially provides a bulk holder for a number of balls and essentially forms a light box. The bottom end of the housing 1 includes a plurality of locking caster wheels 45 facilitating rolling the charger box across a floor. A lid assembly 32 attached to the housing 1 by hinges 46 can close off the interior of housing 1, and a stop block assembly 47 with a stop block arm assembly 48 that can hold the lid assembly 32 in place. Lid assembly 32 can also protect electrical wiring assembly 50 and an off/on switch 16, which can function by turning off and on by opening and closing the lid assembly 32. The inner walls of the housing 1 can include light sources 9, such an array of high intensity LEDs, which can be covered by protection panels 54. The protection panels 54 can be held in place holding tabs 49.

Figure 2:
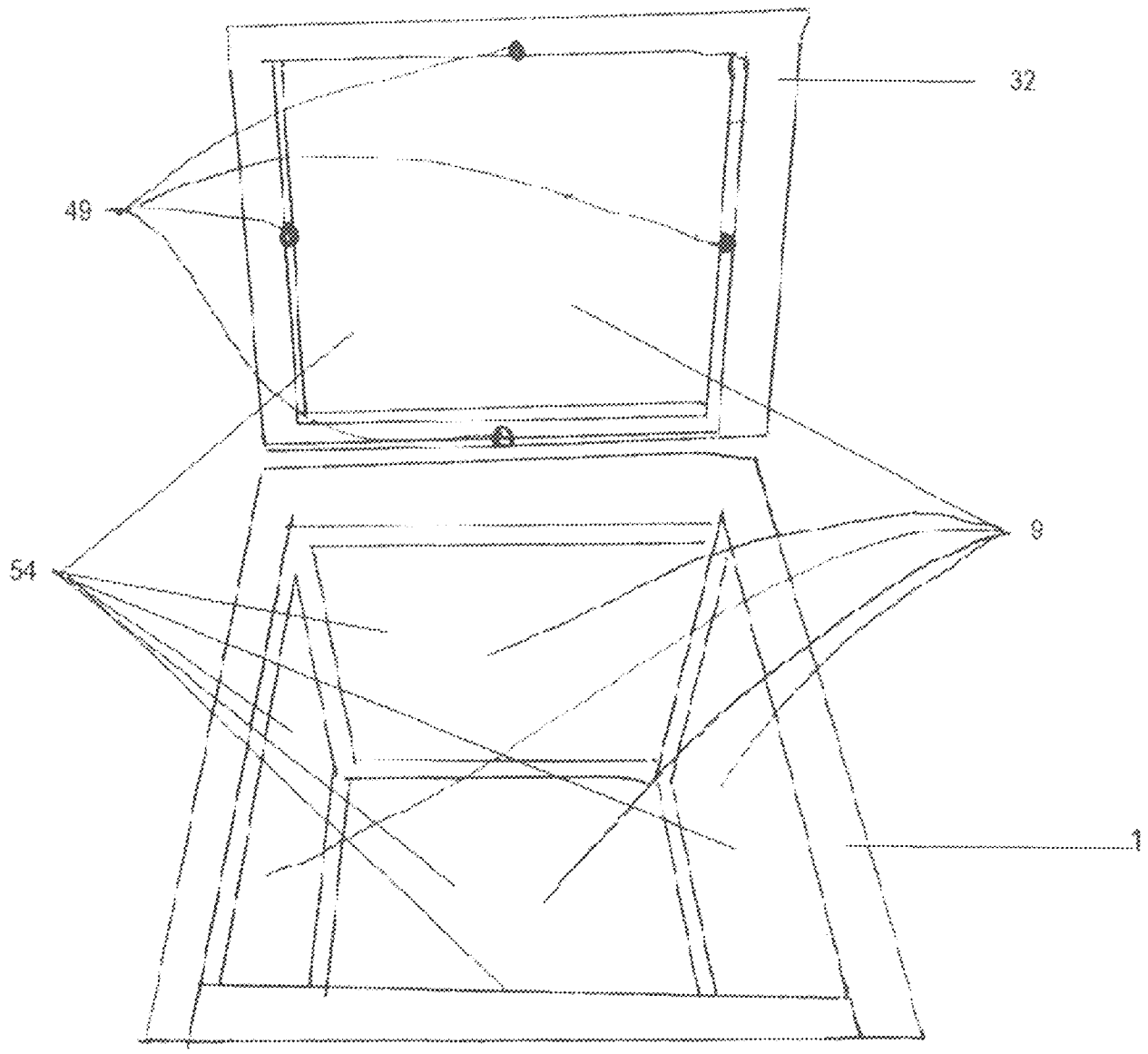
FIG. 2 depicts an isolated perspective view of an embodiment of lid assembly 32 compatible with an embodiment such as described and depicted in FIG. 1, according to a preferred embodiment of the present inventions.

FIG. 2 depicts an isolated perspective view of an embodiment of lid assembly 32. Lid assembly 32 fits over housing 1. Light sources 9 on the inner side of lid assembly 32 and the inner walls of housing 1 provide full coverage of light onto the contents, in this case golf balls. Protective panels 54 protect the light sources 9 from damage, and the protective panels 54 can be held in place by holding tabs 49. Light sources 9 can consist of light panels diffusing high intensity light from LED arrays.

Figure 3:
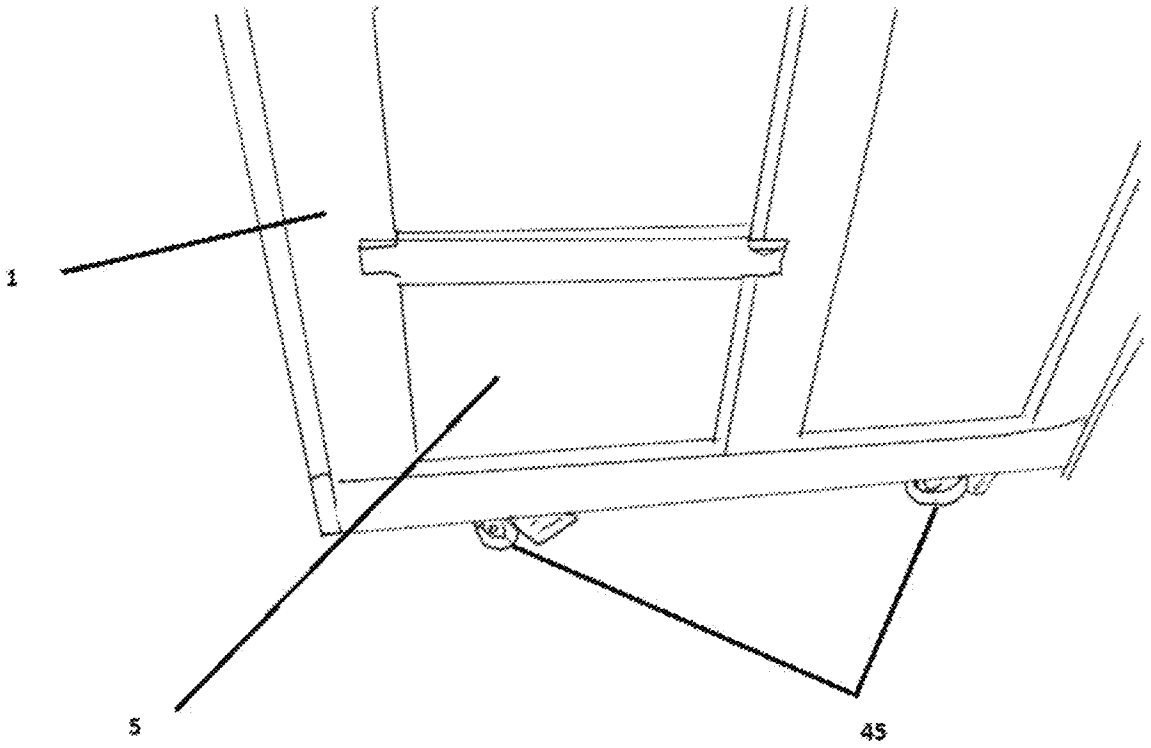
FIG. 3 depicts an embodiment of a back access to the electronics housing 5 section of the housing 1 compatible with an embodiment such as described and depicted in FIG. 1, according to a preferred embodiment of the present inventions.

FIG. 3 depicts a back access to the electronics housing 5 section of the housing 1, which in the metal version can be located on the underside of the box. It also shows the caster wheels 45 locking or non-locking for the ease, safety and portability of the charging box 1 itself.

Figure 4:
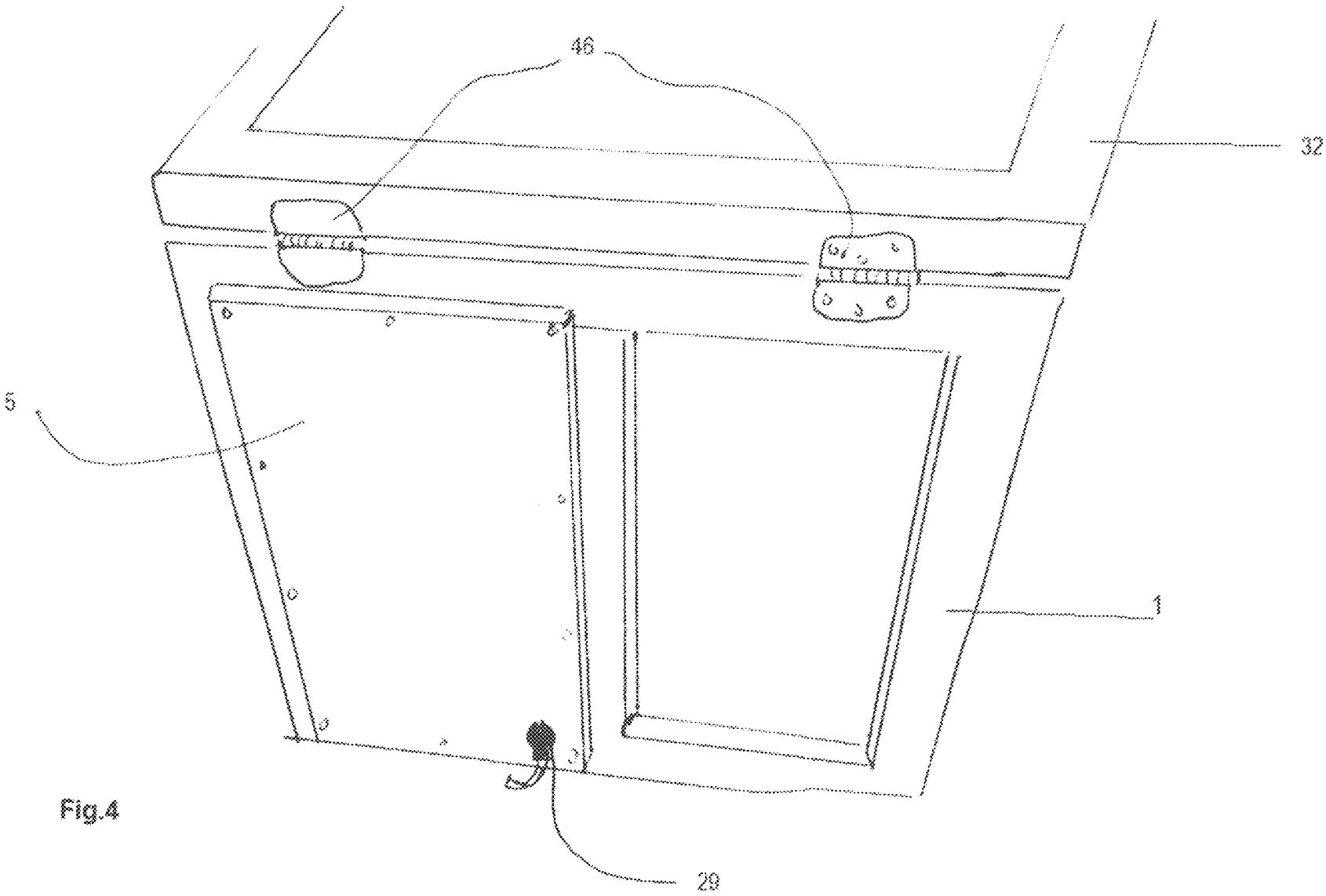
FIG. 4 shows an alternative embodiment of electronics enclosure and power access compatible with an embodiment such as described and depicted in FIG. 1, according to a preferred embodiment of the present inventions.

FIG. 4 shows an alternative embodiment of electronics enclosure and power access. The electric housing is secured by back access panel in charging box/housing 1 and includes power cord 29 extending from the electronics housing 5. Hinges 45 openably secure lid assembly 32 to housing 1.

Figure 5:
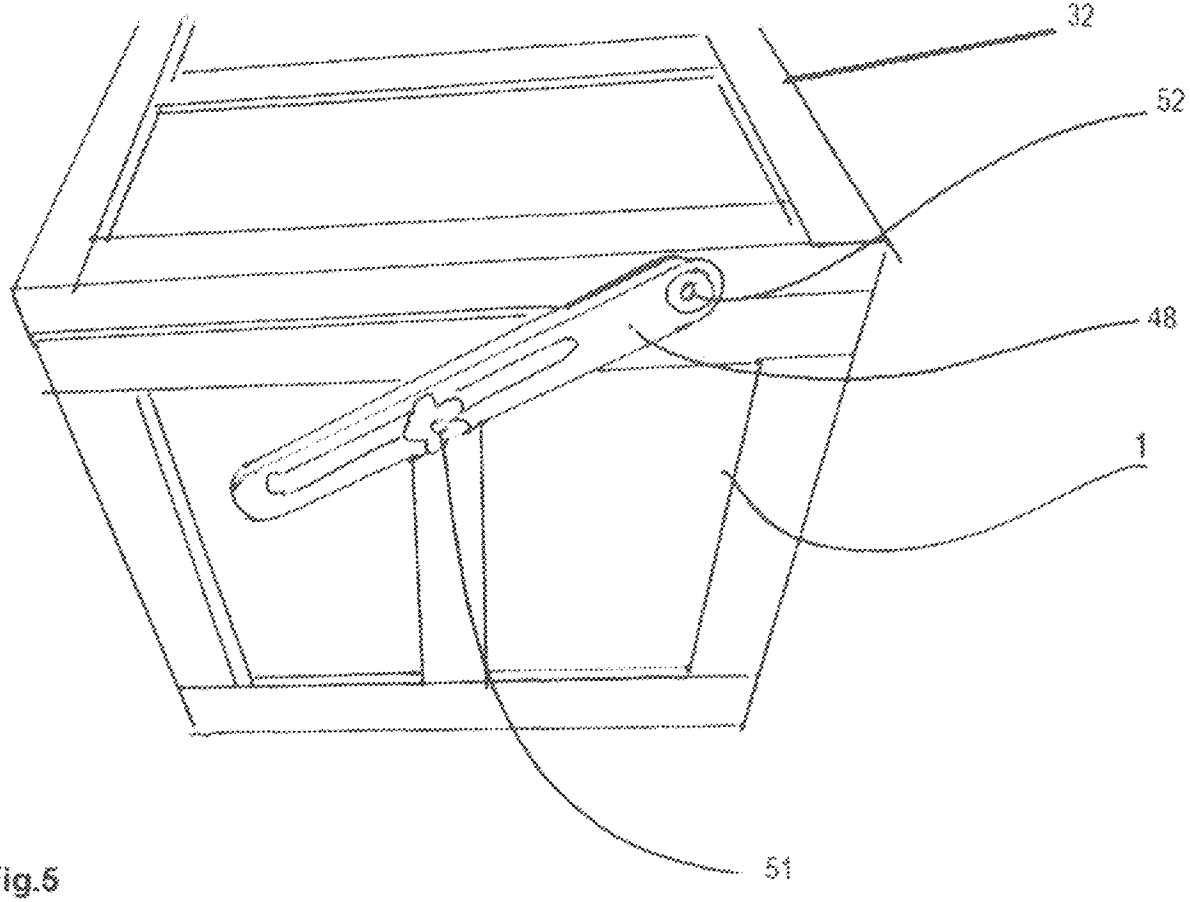
FIG. 5 depicts a side view of a housing that includes a stop block arm assembly enabling the lid assembly 32 such as described and depicted in FIG. 1 to be closed or opened to a desired and then fixed position, according to a preferred embodiment of the present inventions.

As depicted in FIG. 5, a side view of housing 1 includes a stop block arm assembly 48 fastened to lid assembly 32 by pivot screw assembly 52 enabling the lid assembly 32 to be closed or opened to a desired fixed position. Locking nut assembly 51 can be tightened to secure block arm assembly 48 in place or loosened to allow the block arm assembly 48 move and open lid assembly 32.

Figure 6:
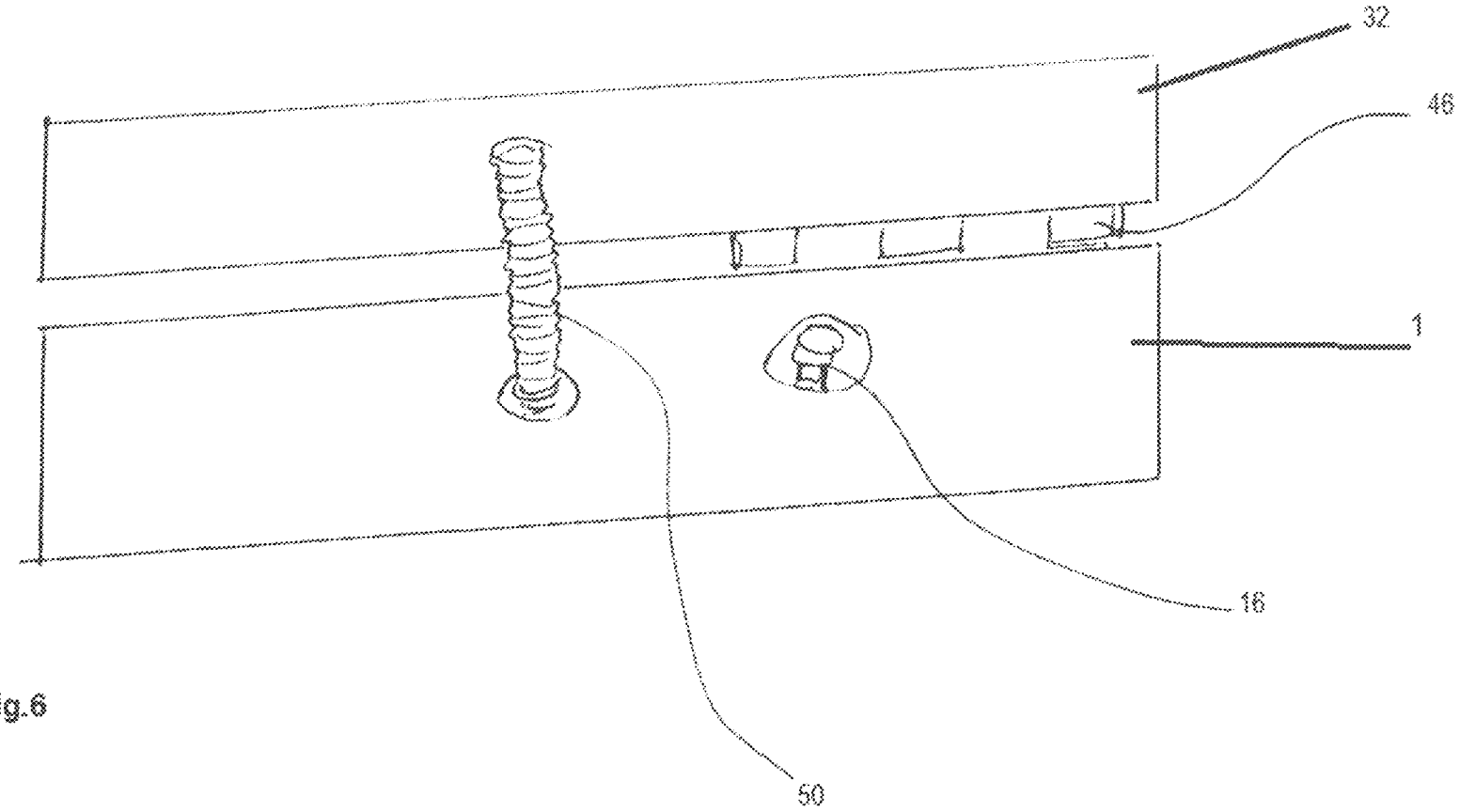
FIG. 6 shows an embodiment of the side of housing with the lid assembly 32 closed such as described and depicted in FIG. 1, according to a preferred embodiment of the present inventions.

FIG. 6 shows an embodiment of the side of housing 1 with the lid assembly 32 closed. In this embodiment, a series of live hinges 46 connects lid assembly 32 to housing 1. Further, a protected electrical wiring assembly 50 provides power from housing 1 to lid assembly 32. On/off switch 16 can control power to the light sources 9 and can be used to turn off the light sources 9 and protect user's adapted night vision when a light charged object is removed from housing 1. In an alternate embodiment, on/off switch 16 can be mounted at a contact point between lid assembly 32 and housing 1 to automatically turn light sources 9 on when lid assembly 32 closes and off when lid assembly 32 opens.

Figure 7:
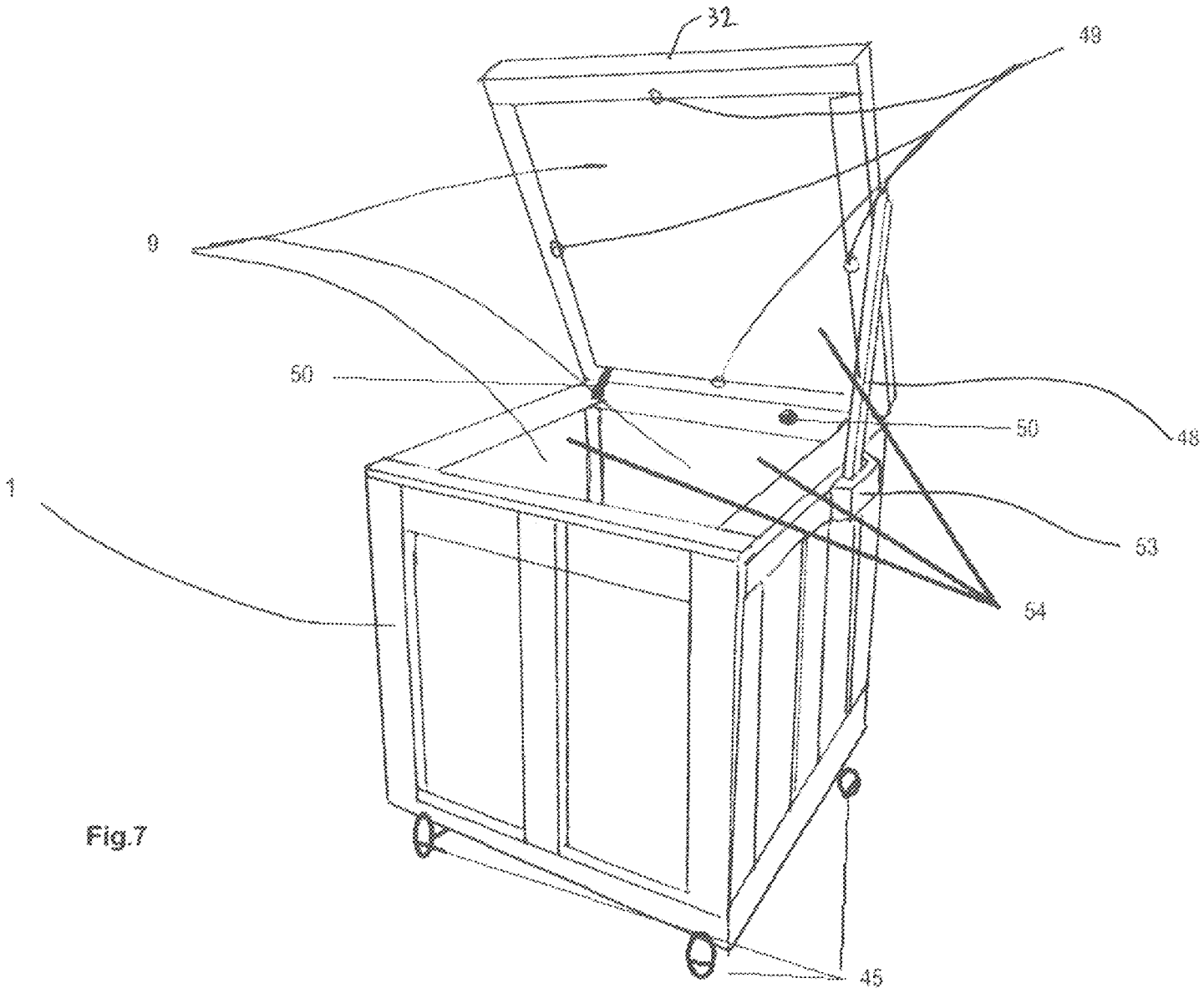
FIG. 7 shows another perspective ¾ view of housing 1 as depicted in FIG. 1, according to a preferred embodiment of the present inventions.

FIG. 7 shows another perspective ¾ view of housing 1. Housing 1 includes a set of caster wheels 45 on the lower end and a lid assembly 32 attached to the upper end. Light sources 9, covered by protection panels 54, provide charging light to charge luminescent objects placed into housing 1, which constitutes a luminescent ball charger that can charge luminescent golf balls. Holding rings 49 secure the protective panels 54 in place. Protected electrical wiring assembly 50 provides power from housing 1 to lid assembly 32. Stop block assembly 50 locks in place to keep lid assembly 32 open.

Figure 8:
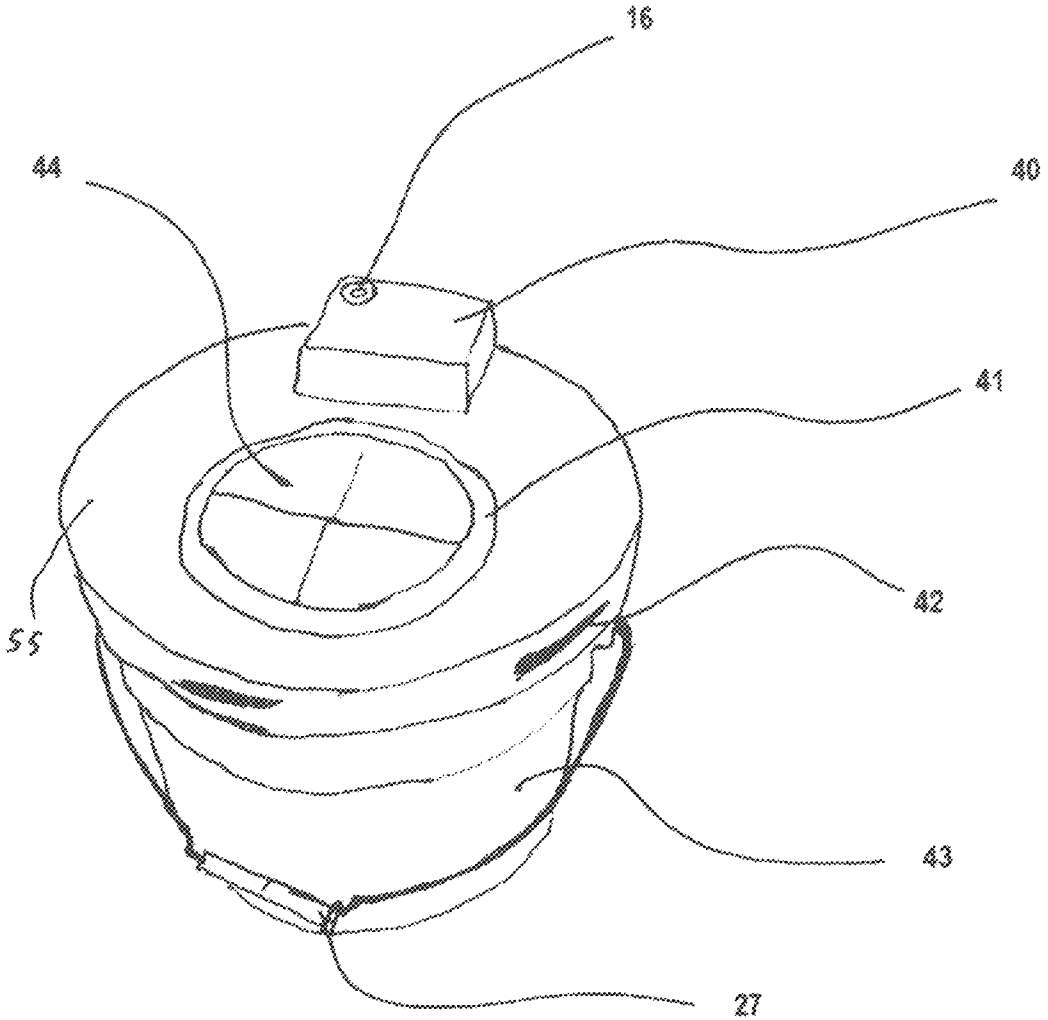
FIG. 8 depicts an embodiment of a light bucket charger/maintainer created using a vacuum formed plastic lid incorporating a light charging assembly.

In another embodiment, as depicted in FIG. 8, a light bucket charger/maintainer is created using a vacuum formed plastic lid. The vacuum formed plastic universal vacuum formed glow ball maintainer lid assembly 55 includes a recessed portal 41 for a light source/light trap panel 44 comprised of brush, foam, rubber, or other similar materials that can easily be pushed aside by a hand passing through. The light trap panel 44 effectively blocks light from escaping from the panel and effecting night or dim lighting adapted eyes of a user. A built-in electronics bay 40 can house various electronic components that includes at least a battery pack and an on/off switch 16.

The universal vacuum formed glow ball maintainer lid assembly 55 is sized to fit over any standard universal size bucket 43 such as a 3-5 gallon bucket, which can include a bucket carry handle 27. The glow ball maintainer lid assembly 55 can further include stepped indents to snap fit onto the circumference of the top rim of universal size bucket 43.

Figure 9:
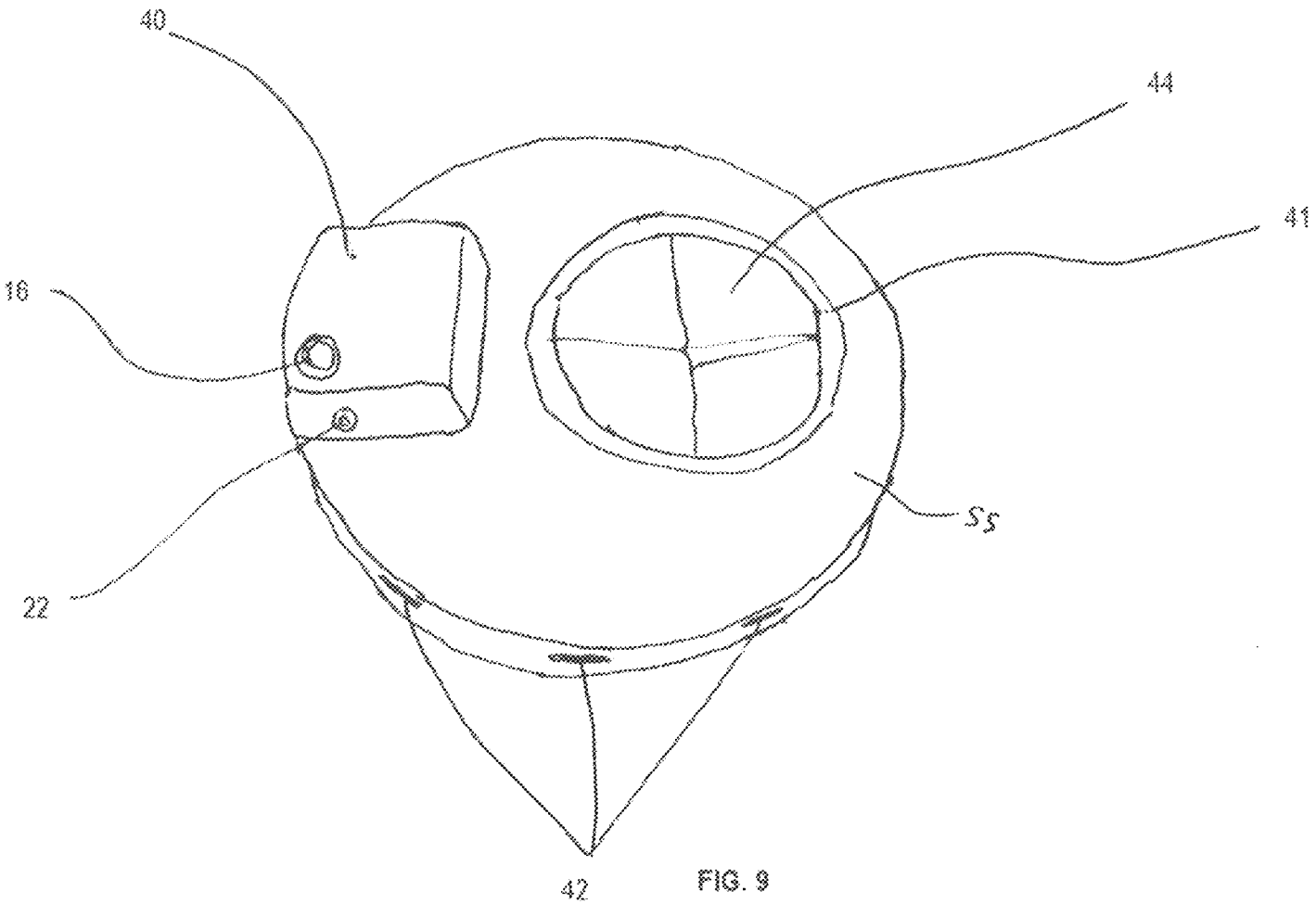
FIG. 9 depicts an isolated top perspective view of the luminescent ball maintainer lid assembly 55 compatible with an embodiment such as described and depicted in FIG. 8, according to a preferred embodiment of the present inventions.

FIG. 9 shows an isolated top perspective view of the glow ball maintainer lid assembly 55 of FIG. 8. The glow ball maintainer lid assembly 55 includes recessed portal 41 topped by a light trap panel 44 comprised of brush, foam, rubber, or other similar materials that can easily be pushed aside by a hand passing through the light trap 44. A built-in electronics bay 40 can house various electronic components that includes at least a battery pack charged by power port 22 used for charging or constant power and on/off switch 16. The glow ball maintainer lid assembly 55 can include stepped indents to snap fit onto the top rim of universal size bucket 43.

Figure 10:
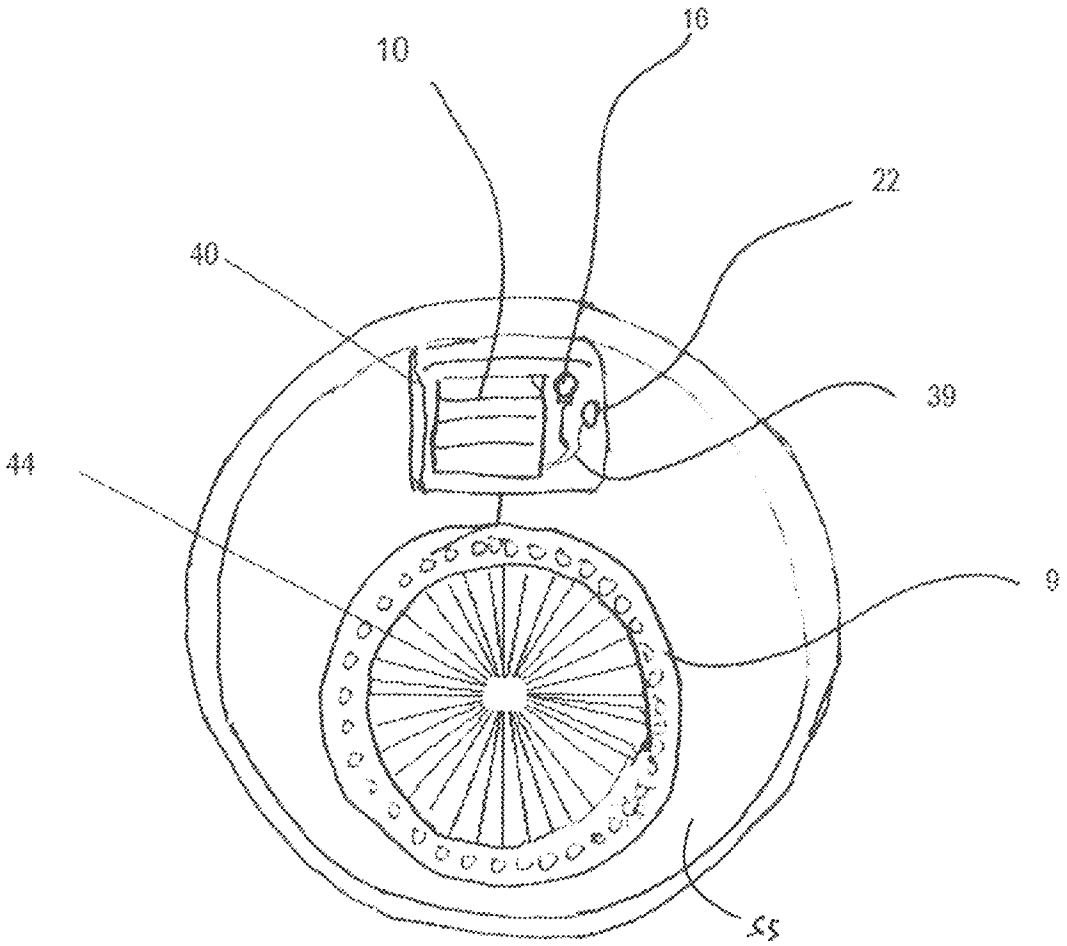
FIG. 10 depicts an embodiment for the underside of the luminescent ball maintainer lid assembly 55 as described and depicted in FIG. 8, according to a preferred embodiment of the present inventions.
Figures 11A, 11B, 11C:
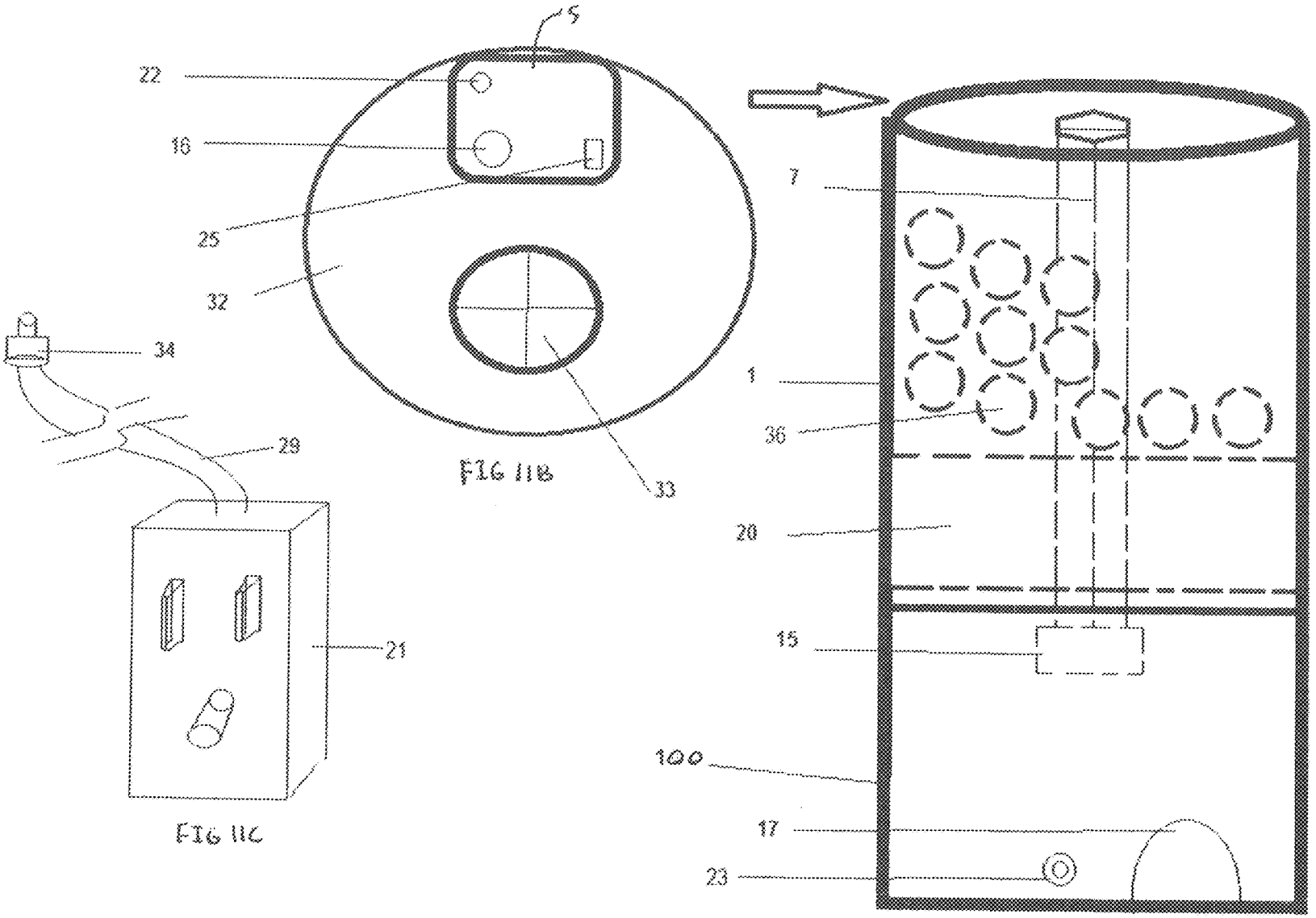
FIG. 11A depicts a front perspective view of a semi or fully automatic charging apparatus for light charging a plurality of luminescent balls so as to cause the plurality luminescent balls or some of the plurality of luminescent balls to luminesce, according to a preferred embodiment of the present inventions.
FIG. 11B depicts a top view of a component of the charging apparatus, according to a preferred embodiment of the present inventions.
FIG. 11C depicts a side perspective view of a charging apparatus, according to a preferred embodiment of the present inventions.

FIG. 10 shows an embodiment for the underside of the glow ball maintainer lid assembly 55. As depicted, the glow ball maintainer lid assembly 55 can include light trap 44 with light source 9 that can consist of an encircling array of LEDs. The LEDs are powered by a rechargeable/replaceable battery pack 10, which can be housed inside built-in electronics bay 40. Electronics bay 40 can house electrical wiring 39 that can connect the electrical components together. This can include an on/off switch 16 and charging port 22.

Referring to FIGS. 11A, 11B, 11C, and 12, a charging apparatus automatically charges a plurality of luminescent balls 36, such as golf balls, so as to cause the plurality balls or some of the plurality of balls to luminesce in the dark. A housing 1 contains and supports the various internal components of the charging apparatus including charged and uncharged luminescent balls 36. A lid assembly 32 attaches onto the upper end of the charging apparatus housing 1. Fill opening cover 33 allows for placing luminescent balls 36 into housing 1. An electronics housing 5 can include control interfaces comprised of on/off switch 16 and motor control switch 25 to provide an on/off function and motor control functions for semi-auto or automatic function controlling motor 4 (also located in electronic housing 5). A power port 22 can accommodate charging or constant power provided from a power transformer 21 with a power cord 29 and transformer plug 34, which can plug into an AC wall outlet (not shown).

Housing 1 can also include a drive shaft 7 rotated by motor 4 for rotating various internal plates such as lower guide ball friction plate 14 and luminescent light chamber mounting plate 13. Retaining stop 15 can maintain luminescent light chamber mounting plate 13 in proper position when operating. Luminescent light chamber mounting guides 11 on the interior sides of housing 1 can further keep plates 13 and 14 in alignment vertically to freely rotate. Housing 1 also includes luminescent charging assemblies 20.

Lower second housing 100, located below housing 1, can further include ball ejection exit point 17 for ejecting charged balls, and trigger sensor 23 can be configured to react to motion and used to control the motor 4 and/or the ejecting of a ball 36 from ball ejection exit point 17 when activated. Handle brackets 27 can used to attach carry handles to housing 1 and facilitate carrying the charging apparatus from place to place.

Figure 12:
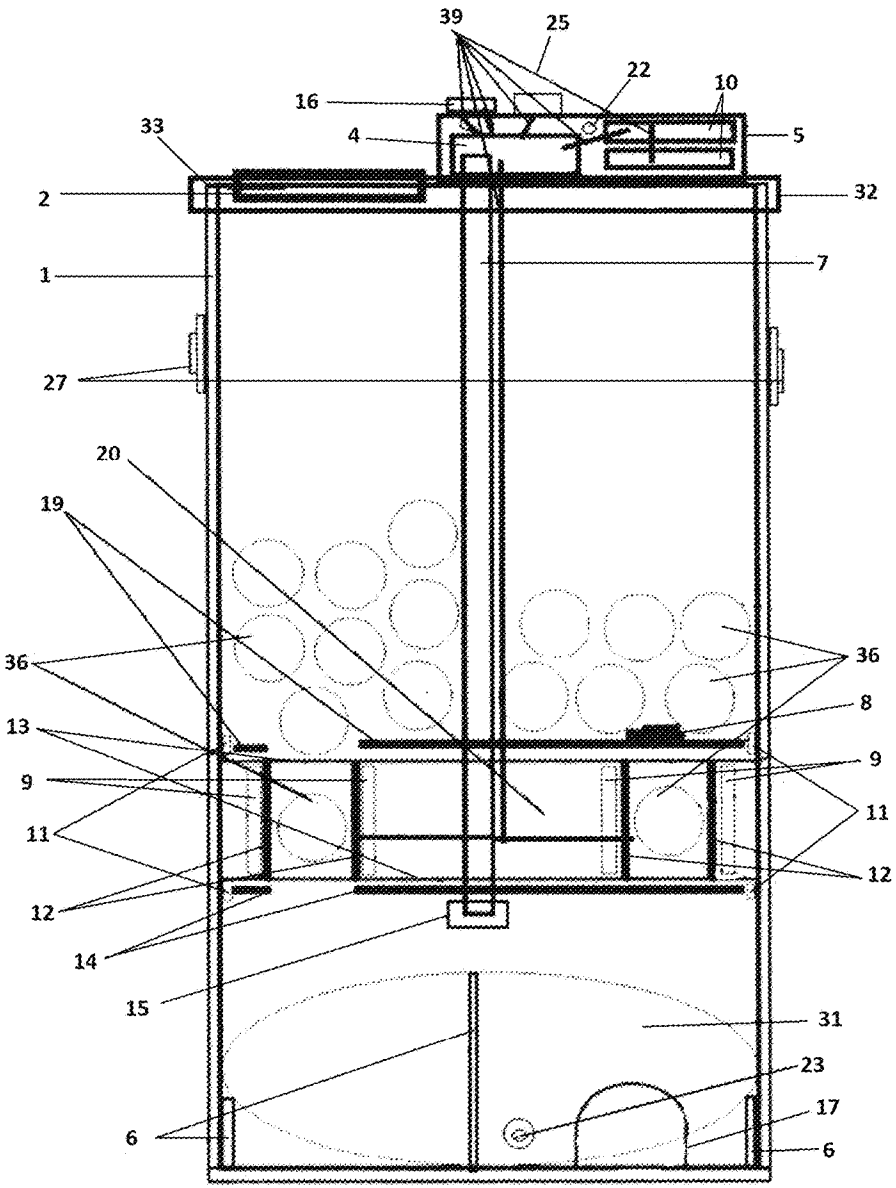
FIG. 12 depicts a cross section view of the luminescent ball charging apparatus, according to a preferred embodiment of the present inventions.

Referring more particularly to FIG. 12, which depicts a side view cutaway of a portable, cylindrical charging apparatus embodiment, the electronics housing 5 located on lid assembly 32 includes motor control switches 25, a rechargeable battery pack 10, motor 4, and wiring 39 connecting the various electrical components. Fill opening 2 and fill opening cover 33 permits inserting a plurality of luminescent balls 36 into the housing 1. Electric motor 4 can rotate drive shaft 7. The lid assembly 32 can be of a snap on snap off configuration, fitting onto a top end rim of housing 1.

A plurality of uncharged luminescent balls 36 can rest against upper guide ball ejection plate 19, which drive shaft 7 can rotate and allow for a luminescent golf ball 36 to pass through a portal in the upper guide ball ejection plate 19, when it aligns with a corresponding portal in the luminescent light chamber mounting plate 13, to fall into luminescent light chambers 12 of the clear luminescent charging assembly 20. The ball bump 8 on upper guide ball ejection plate 19 helps guide and rotate the luminescent balls 36 as they move around to fall into the clear luminescent charging assembly 20. Inside the clear luminescent charging assembly 20, the light sources 9 expose all surfaces of luminescent balls 36 as the rotating lower guide ball friction plate 14 rotates the luminescent balls 36 inside the luminescent charging assembly 20 fall through plate ejection portal 56. As can be readily understood, the lower guide ball friction plate 14 interacts with luminescent balls 36 to rotate and expose the entire surface to charging light emitted from light sources 9. The plates 13, 14, and 19 are kept aligned by luminescent light chamber mounting guides 11, and retaining stop for luminescent plates 15 helps ensure the plates 13, 14, and 19 remain in place vertically.

After a revolution of charging inside clear luminescent charging assembly 20, luminescent balls 36 drop through a portal on the lower guide ball friction plate 14 from clear luminescent light chambers 12 to fall onto an adjustable angle ejection plate 31 to facilitate luminescent balls 36 rolling to and through ball ejection exit point 17. The angle of adjustable angle ejection plate 19 can be adjusted using guide stops 16. Trigger sensor 23 can operate the motor controls to activate the charging apparatus to cause one or more charged luminescent balls 36 to enter the clear luminescent light chambers 12 as one or more luminescent balls 36 eject from the ball ejection exit point 17. The trigger sensor 23 can operate the charging apparatus automatically to eject a stream of luminescent balls 36 on a pre-set timed interval or on a one time basis in semi-automatic mode.

Figure 13:
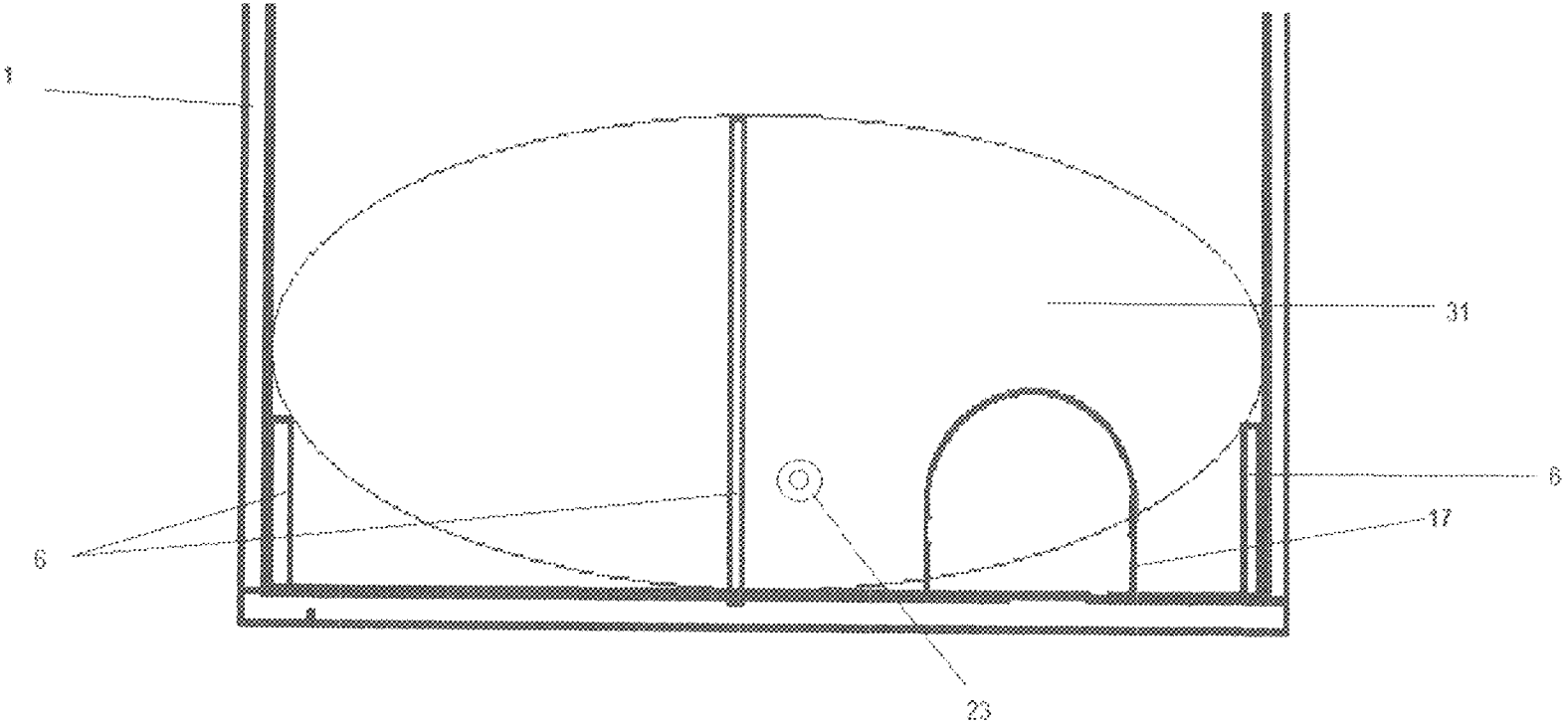
FIG. 13 depicts additional details of the lower ejection ramp formed by the adjustable angle ejection plate 31 in FIG. 12, according to a preferred embodiment of the present inventions.

FIG. 13 shows additional details of the lower ejection ramp formed by the adjustable angle ejection plate 31. Housing 1 can include in a lower end compartment an adjustable angle ejection plate 31, with an angle that can be adjusted by guide stops for varying the ejection angle 16. The guide stops for varying the ejection angle 16 can attach to an inner wall of housing 16. Trigger sensor 23 can operate to eject a luminescent ball 36 from ball ejection exit point 17 when activated by a user.

Figure 14:
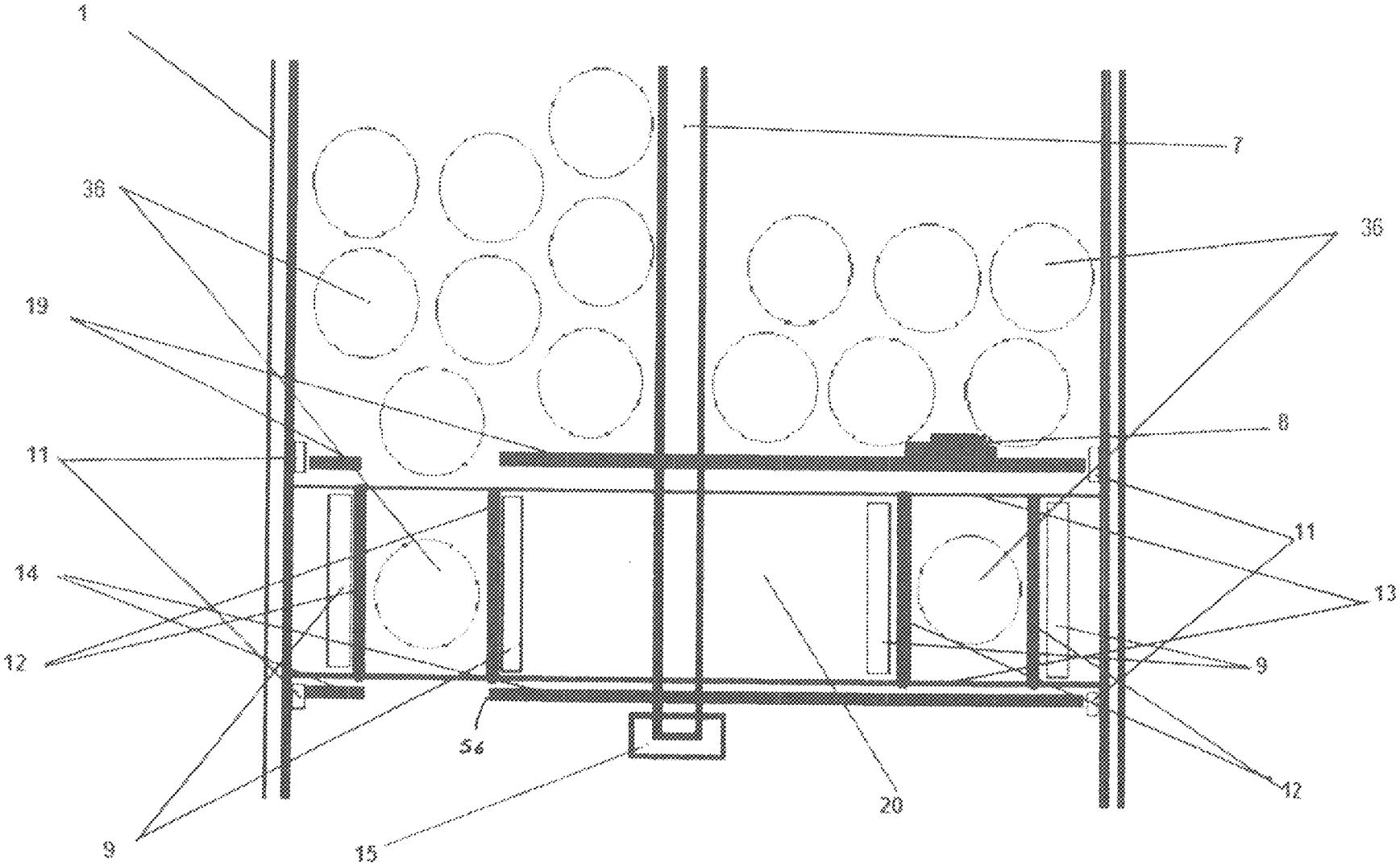
FIG. 14 depicts an upper end of the charging apparatus of housing 1 such as depicted in FIG. 12 that essentially forms a ball holding area or hopper above clear luminescent charging assembly 20, according to a preferred embodiment of the present inventions.

FIG. 14 depicts the upper end of the charging apparatus where housing 1 essentially forms a ball holding area or hopper above clear luminescent charging assembly 20. As shown, drive shaft 7 passes through the center of housing 1, which holds a plurality of luminescent balls 36. The plurality of luminescent balls 36 rests against upper guide injection plate 19. Drive shaft 7 rotates and feeds luminescent golf ball 36 to a portal in the upper guide ball ejection plate 19, and when the upper guide ball ejection plate 19 aligns with a corresponding portal in the luminescent light chamber mounting plate 13, a luminescent ball 36 falls into luminescent light chambers 12 of the clear luminescent charging assembly 20. The ball bump 8 on upper guide ball ejection plate 19 helps guide and rotate the luminescent balls 36 as they move around to fall into the clear luminescent charging assembly 20. Inside the clear luminescent charging assembly 20, the light sources 9 expose all surfaces of the luminescent balls 36 as the rotating lower guide ball friction plate 14 rotates the luminescent balls 36 inside the luminescent charging assembly 20. As can be readily understood, the lower guide ball friction plate 14 interacts with luminescent balls 36 to rotate and expose the entire surface to charging light emitted from light sources 9. The plates 13, 14, and 19 are kept aligned by luminescent light chamber mounting guides 11, and retaining stop for luminescent plates 15 helps ensure the plates 13, 14, and 19 remain in place vertically.

Figure 15:
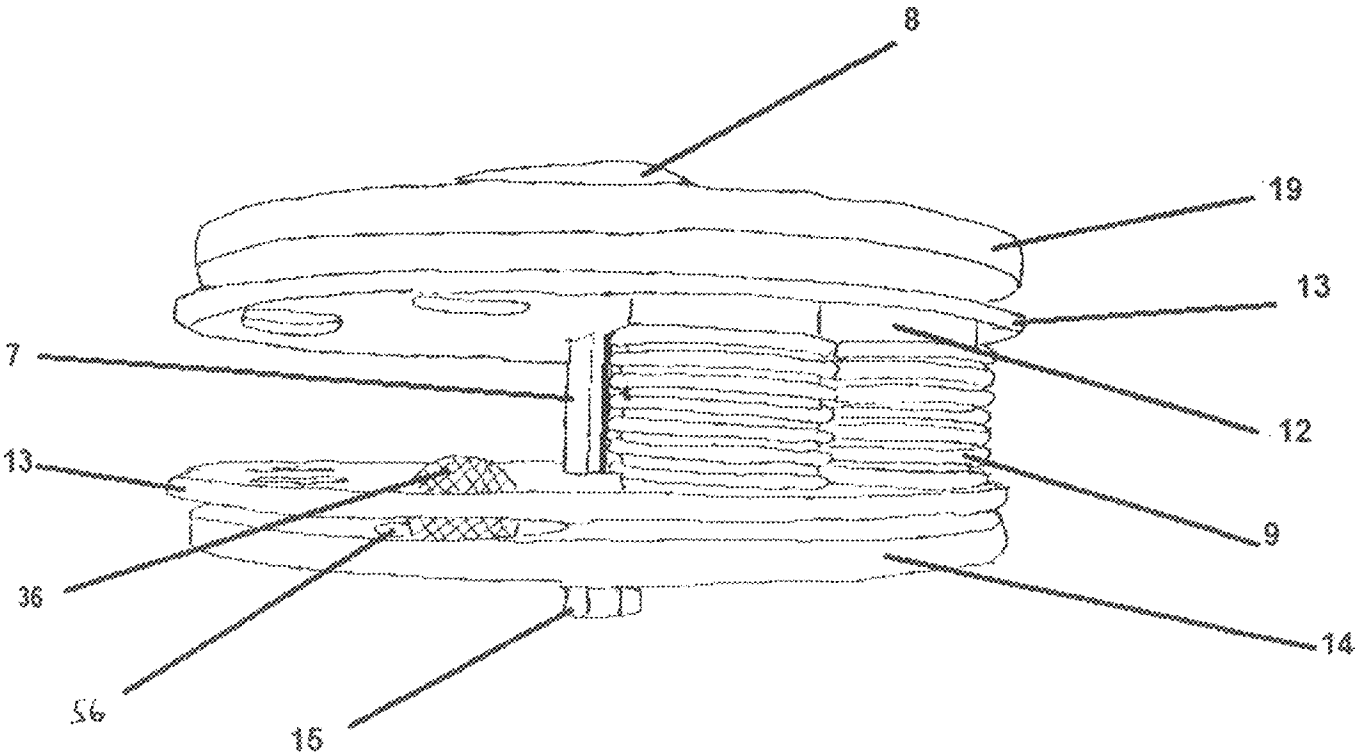
FIG. 15 depicts an isolated sideview of the clear luminescent charging assembly 20 such as depicted in FIG. 12, according to a preferred embodiment of the present inventions.

FIG. 15 shows an isolated sideview of the clear luminescent charging assembly 20. The clear luminescent charging assembly 20 as depicted includes a rotating luminescent light chamber mounting plate 13 on the upper end and a rotating lower guide ball friction plate 14 on the lower end. The rotating plates align to remove luminescent balls 36 from the clear luminescent charging assembly 20 by positioning the luminescent balls 36 to pass through plate ejection portal 56.

As depicted, the clear luminescent charging assembly 20 consists of multiple, individual clear luminescent light chambers 12 held in position by luminescent light chamber mounting plate 13. Each clear luminescent light chamber 12 is sized to receive one luminescent ball 36 and is further formed by a cylindrical arrangement of light sources 9 configured to surround each single luminescent ball 36. In an embodiment, light sources 9 can comprise a linear array of LEDs embedded in a clear acrylic or other plastic or resin formed as an open top and bottom cylinder. In yet another embodiment, the linear array light sources 9 can be formed into a spiral to fit around a clear luminescent light chamber 12. The clear luminescent light chamber 12 in conjunction with light sources 9 can function as a light diffuser and light panel illuminating the clear luminescent light chamber 12. In some alternative embodiments, the light sources 9 can be configured as a luminescent and flexible flat panel or strip that fits the length and width of a formed cylinder in the luminescent light chamber 12. In some embodiments, the clear luminescent light chamber 12 can be constructed from either a translucent or transparent material.

In an embodiment, in operation, the upper guide ball injection plate 19 and lower guide friction plate 14 can be in fixed relative position to each other and can rotate with luminescent light chamber mounting plates 13 fixed in position. As portals in the various plates align, luminescent balls 36 pass through into the clear luminescent charging assembly 20. In another embodiment, the luminescent light chamber mounting plates 13 can rotate, with the upper guide ball injection plate 19 and lower guide friction plate 14 fixed. Again, as portals in the various plates align, luminescent balls 36 pass through into the clear luminescent charging assembly 20.

FIG. 16 shows further details of an embodiment of clear luminescent charging assembly 20 during operation. As depicted, upper guide ball injection plate 19 rotates by action of drive shaft 7. A retaining stop for luminescent plates 15 keeps upper guide ball injection plate 19 from migrating upwards. Ball bumps 8 will interact with a plurality of luminescent balls to maneuver luminescent ball 36 in position to fall through upper guide ball injection plate 19 and into clear luminescent charging assembly 20 when motor 4 activates to rotate drive shaft 7.

Once in position with openings in upper guide ball injection plate 19 and luminescent light chamber mounting plate 13 aligned with each other, a luminescent ball 36 can pass/fall into one of a plurality of clear luminescent light chambers 12, which are fully illuminated by high intensity light from light sources 9. As luminescent light chamber mounting plate 13 rotates around inside clear luminescent charging assembly 20, the luminescent balls 36 contained therein become fully charged with light energy. Each one of the clear luminescent light chambers 12 in a preferred embodiment takes the form of an open cylinder with light sources 9 forming the cylinder walls as depicted.

After approximately a full revolution inside the clear luminescent charging assembly 20, the open bottoms of clear luminescent light chambers 12 will align with plate ejection portal 56 in lower guide ball friction plate 14 to fall into the lower portion of housing 1. One or more light charged luminescent balls 36 can be store therein until ejected from ball ejection exit point 17.

Figure 17:
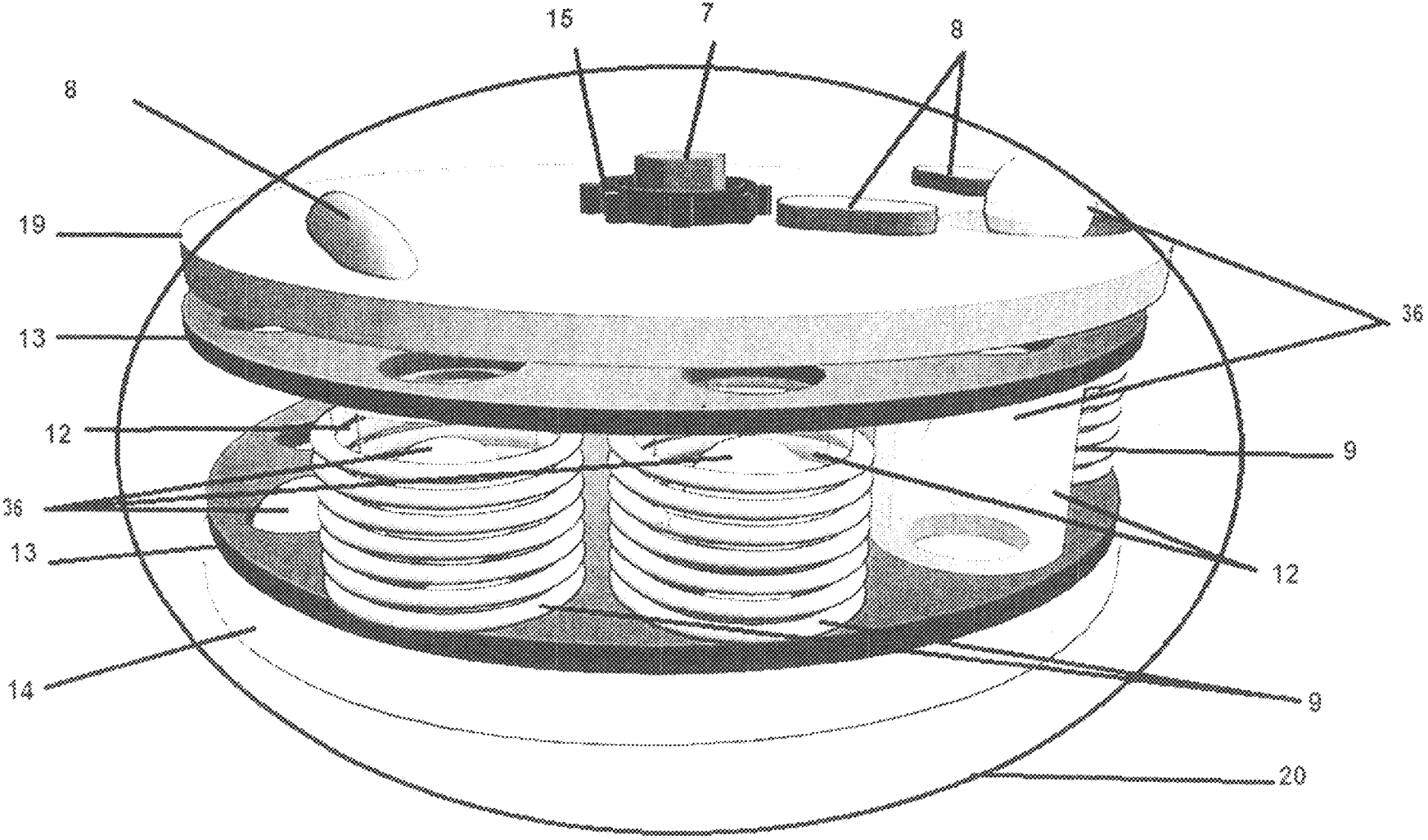
FIG. 17 depicts yet another drawing of an embodiment of clear luminescent charging assembly 20 such as depicted in FIG. 12, according to a preferred embodiment of the present inventions.
Figure 18:
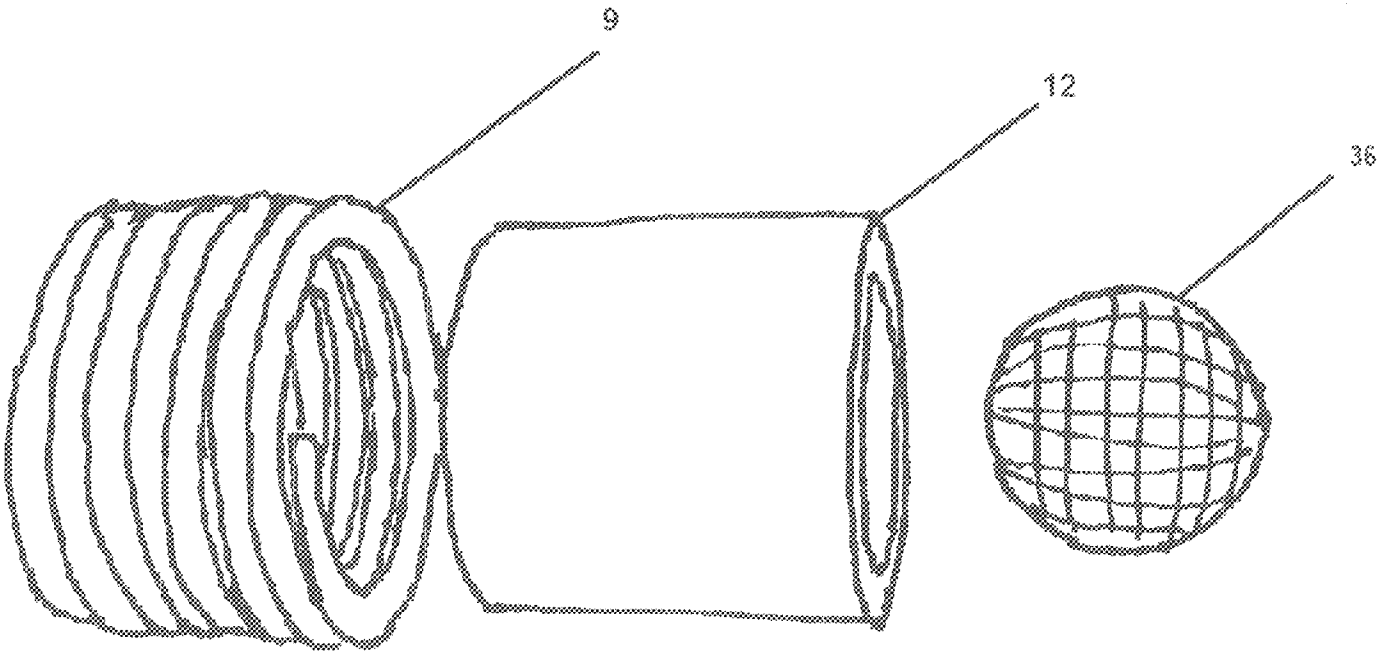

FIG. 17 is yet another drawing of an embodiment of clear luminescent charging assembly 20. As depicted, a retaining stop for luminescent plates 15 keeps upper guide ball injection plate 19 from migrating upwards as upper guide ball injection plate 19 rotates by action of drive shaft 7. Ball bumps 8 on upper guide ball injection plate 19 will interact with a plurality of luminescent balls 36 to maneuver one luminescent ball 36 in position to fall through upper guide ball injection plate 19 and into clear luminescent light chambers 12 when motor 4 activates to rotate drive shaft 7.

Once in position with openings in both upper guide ball injection plate 19 and luminescent light chamber mounting plate 13 aligned with each other, a luminescent ball 36 can pass/fall into one of a plurality of clear luminescent light chambers 12, which are fully illuminated by high intensity light from sources 9. As portals in luminescent light chamber mounting plate 13 lower guide ball friction plate 14 align, luminescent ball 36 passes out of clear luminescent charging assembly 20. The luminescent balls 36 contained therein become fully charged with light energy. Each one of the clear luminescent light chambers 12 in a preferred embodiment takes the form of an open-ended cylinder with light sources 9 forming the cylinder walls as depicted.

After approximately a full revolution of plate 13 (or plate 14), the open bottoms of clear luminescent light chambers 12 will align with plate ejection portal 56 in lower guide ball friction plate 14 allowing luminescent ball 36 to fall from clear luminescent charging assembly 20 into the lower portion of housing 1. Note, that if the luminescent light chamber mounting plate 13 are configured to rotate, then the clear luminescent light chambers 12 in clear luminescent charging assembly 20 rotate as well.

Figure 18:
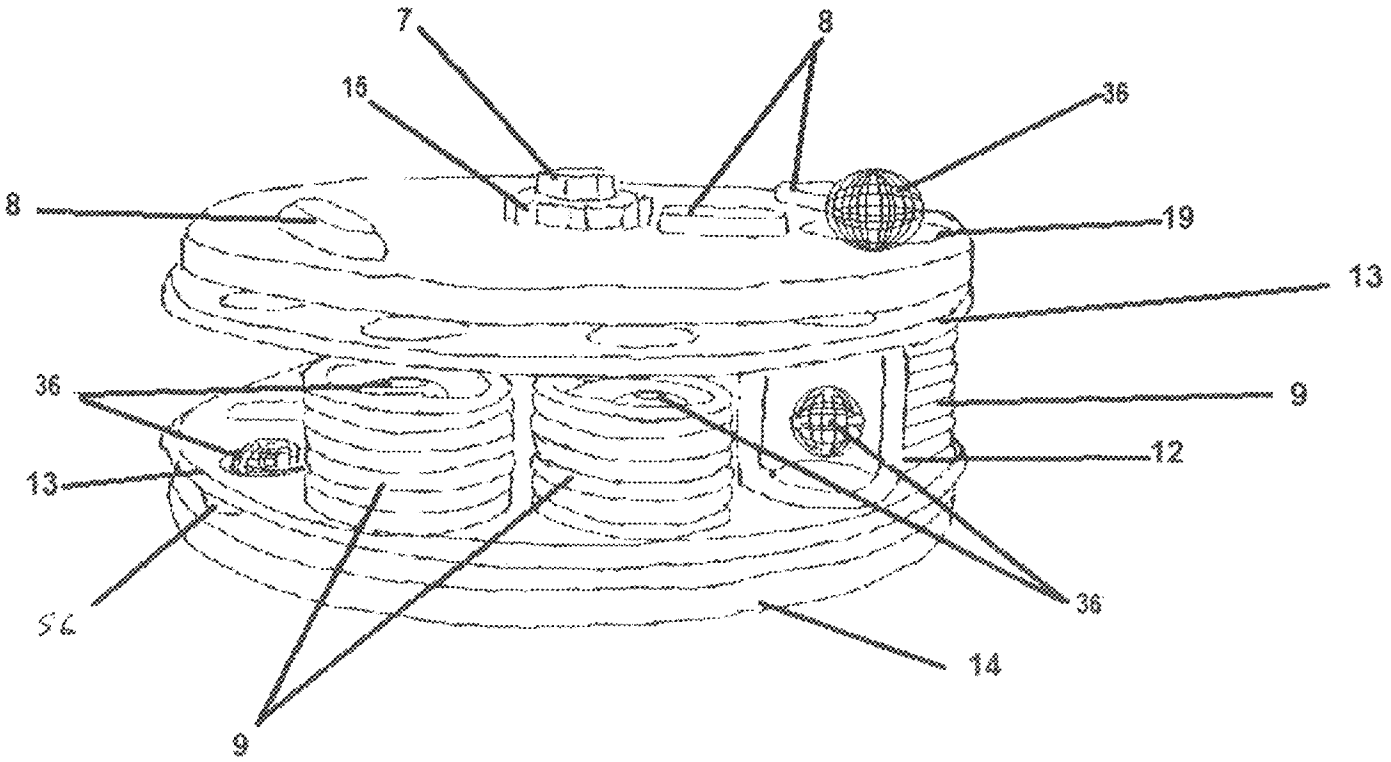
FIG. 18 depicts an exploded side view of an embodiment for a clear luminescent light chamber, according to a preferred embodiment of the present inventions.

An exploded side view of an embodiment for a clear luminescent light chamber 12 is depicted in FIG. 18. As depicted, clear luminescent light chamber 12 is a clear open-ended cylinder made from clear plastic, acrylic, or some other clear resin, such as Lucite®, or polycarbonate. An array of light sources 9 made up of a linear string of LEDs or similar light sources and configured into a spiral to fit around the cylindrical clear luminescent light chamber 12. Luminescent ball 36 can be received by clear luminescent light chamber 12, so that light sources 9 radiates light onto all surfaces of luminescent ball 36. In alternative embodiments, the light sources 9 can be configured as a luminescent and flexible flat panel or strip that fits the length and width of a formed cylinder in the luminescent light chamber 12.

Figure 19:
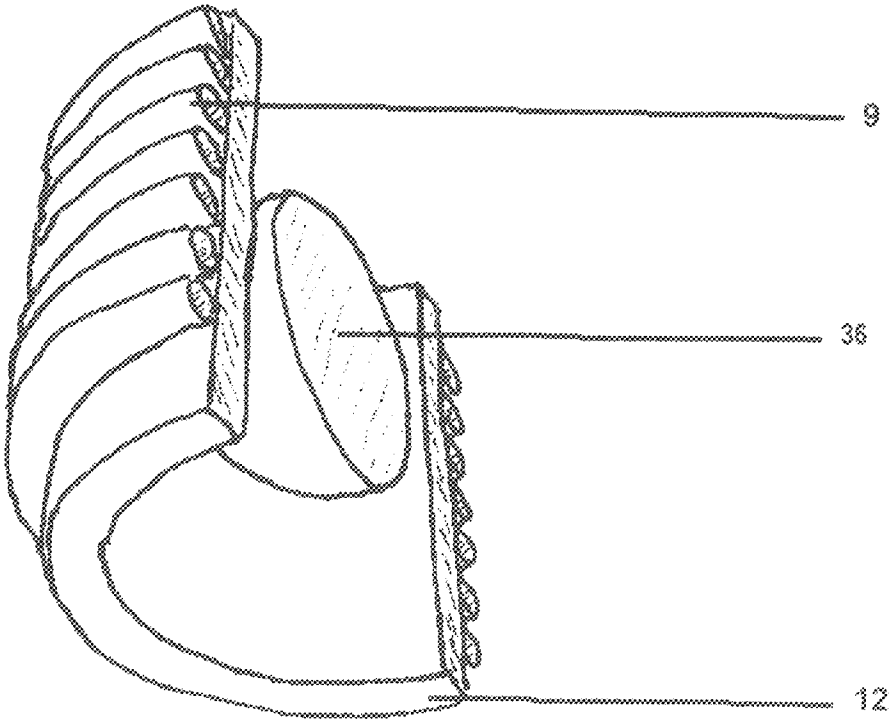
FIG. 19 depicts a sectional perspective view of the clear luminescent light chamber 12 such as depicted in FIG. 18, according to a preferred embodiment of the present inventions.

FIG. 19 shows a sectional perspective view of the clear luminescent light chamber 12 as depicted in FIG. 18. Clear luminescent light chamber 12 as shown is a clear cylinder made from a clear plastic, resin, or acrylic material and is sized to fit into a cylindrical light source 9, which can be formed using a cylindrical string of connected LEDs embedded in an elongated tube wound around clear luminescent light chamber 12. In another embodiment, light source 9 can be formed from a cylindrical constructed fluorescent tube that emits light. In another alternative embodiment, the light sources 9 can be configured as a luminescent and flexible flat panel or strip that fits the length and width of a formed cylinder in the luminescent light chamber 12. Clear luminescent light chamber 12 is also sized to receive a luminescent ball 36 within the cylinder.

Figure 20:
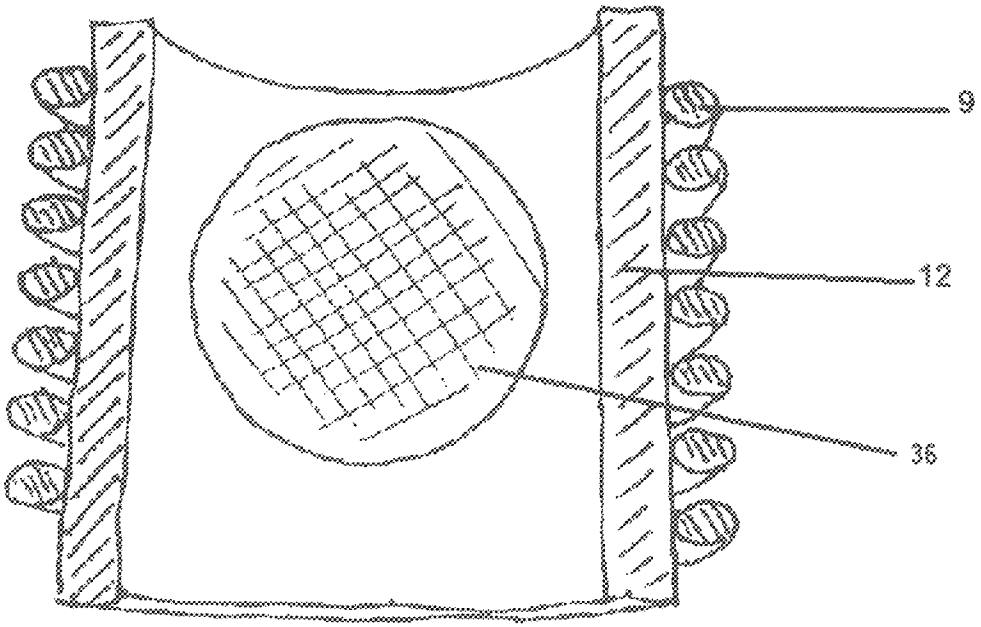
FIG. 20 depicts a front cross-sectional view of the clear luminescent light chamber 12 such as depicted in FIG. 18, according to a preferred embodiment of the present inventions.

FIG. 20 shows a front cross-sectional view of the clear luminescent light chamber 12 as depicted in FIG. 18. The luminescent ball 36 fits within the cylindrical clear luminescent light chamber 12, which in turn is surrounded by light source 9, which can consist of an elongated tube wound into a spiral to form a cylinder to fit around clear luminescent light chamber 12. In an alternative embodiment, the light sources 9 can be configured as a luminescent and flexible flat panel or strip that fits the length and width of a formed cylinder in the luminescent light chamber 12.

Figure 21:
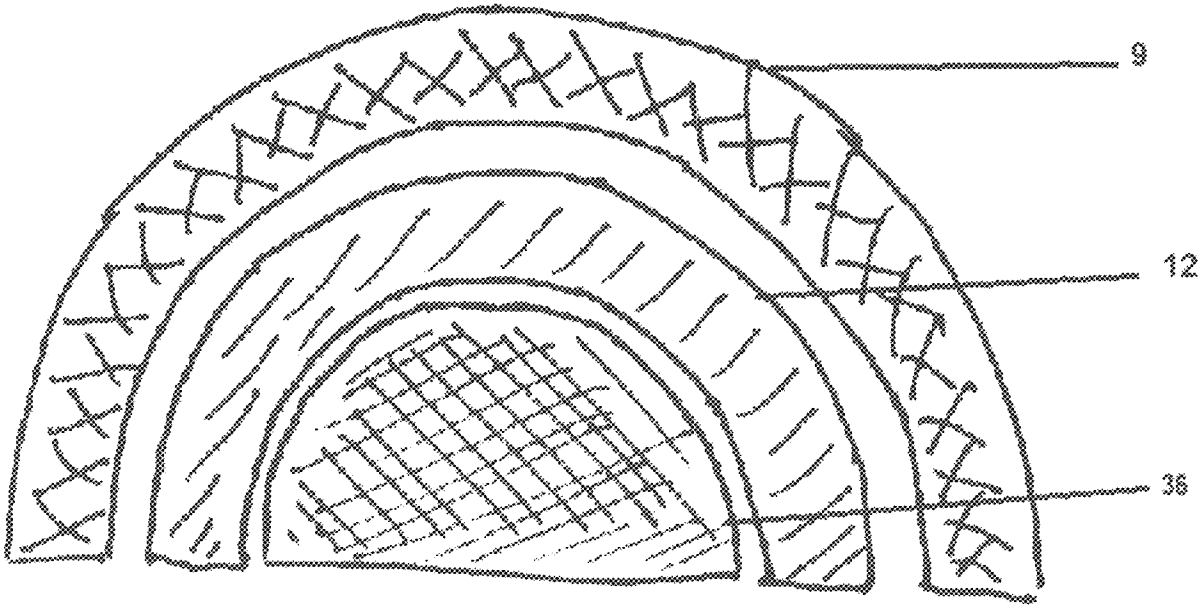
FIG. 21 shows a top down cross section view of clear luminescent light chamber such as depicted in FIG. 18, according to a preferred embodiment of the present inventions.

FIG. 21 shows a top down cross section view of clear luminescent light chamber 12 as depicted in FIG. 18. Going from inner to outer structures, a luminescent ball 36 rest in the center of clear luminescent light chamber 12, and clear luminescent light chamber 12 is surrounded by light source 9.

Figure 22:
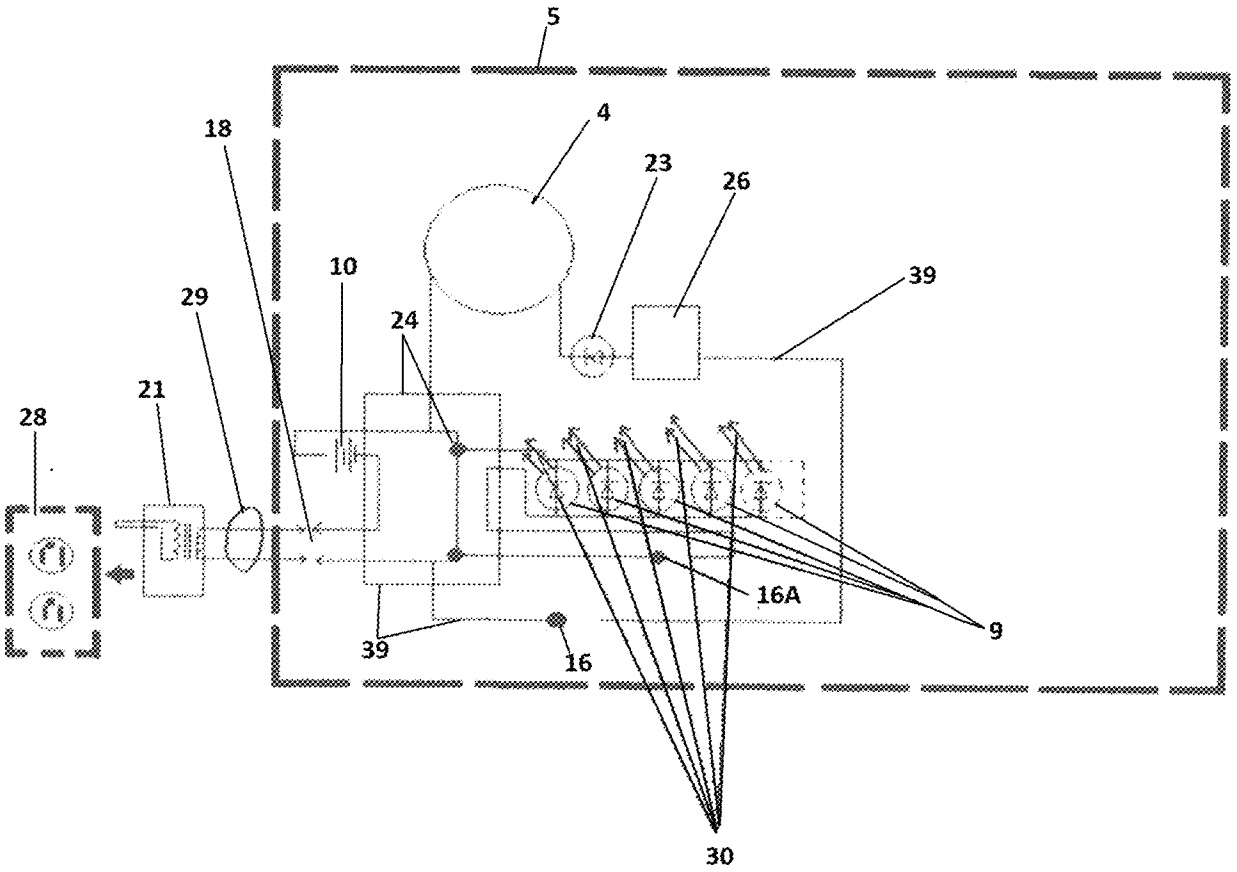
FIG. 22 depicts a general block diagram of the electronics contained in the electronics housing, according to a preferred embodiment of the present inventions.

FIG. 22 depicts a general block diagram of the electronics contained in electronics housing 5. Electronics housing 5 can include an electric circuit composed of wiring 39, a motor 4, trigger sensors for activating motor 23, a microcontroller 26 for implementing semiautomatic or automatic operation, an on/off switch 16, light sources 9, which can consists of an array of LEDs, which emits light rays 30, rechargeable or replaceable batteries 10, and A/C or D/C converters 18. Terminal strips 24 attach light sources 9 to the electric circuit. Power cord 29 connects to power transformers 21, which connects to duplex outlet 28.

Figure 23:
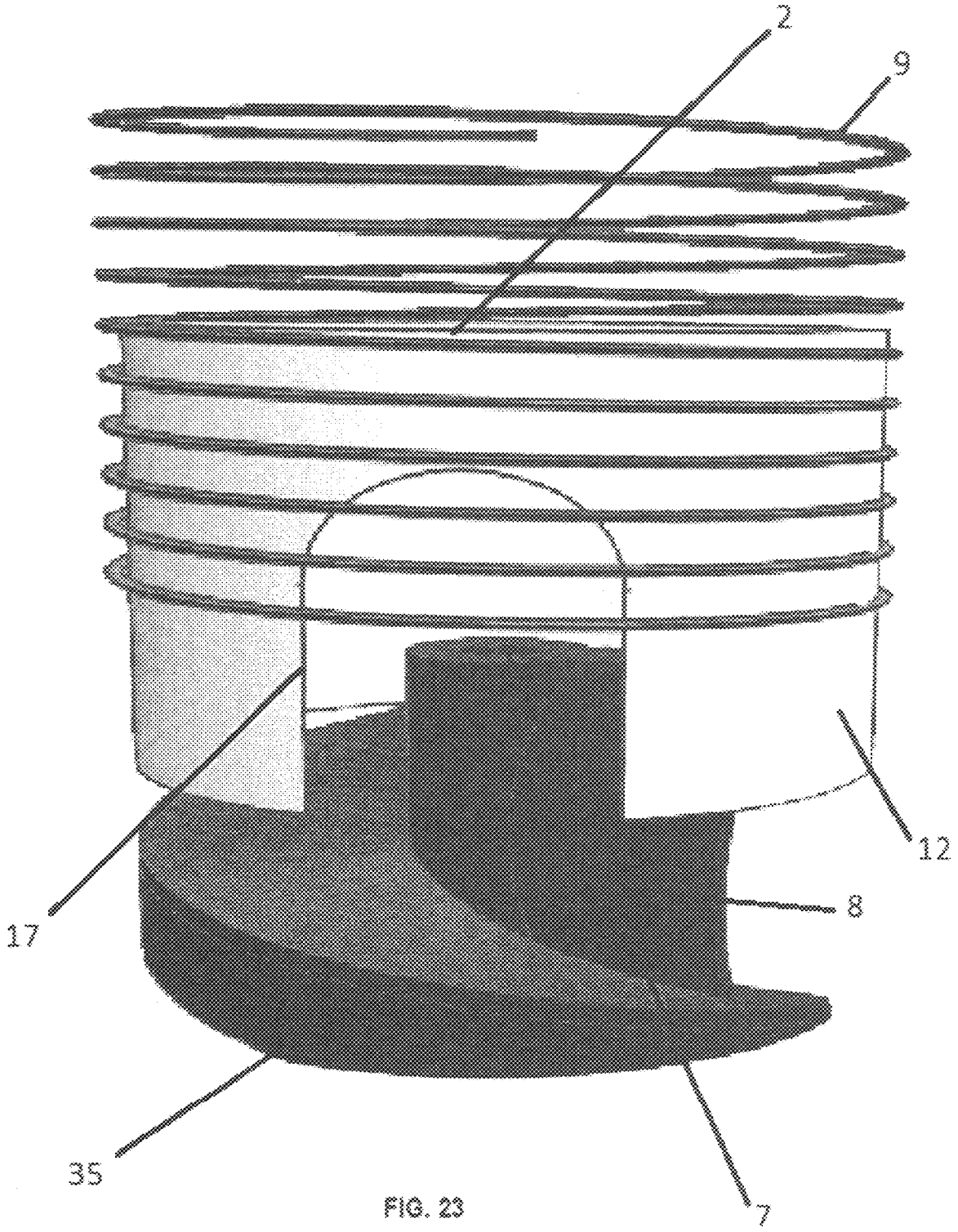
FIG. 23 depicts a luminescent ball auger transport and light charging housing that can be positioned inside housing, according to a preferred embodiment of the present inventions.

FIG. 23 depicts a luminescent balls 36 transport light charging housing that can be housed inside housing 1. In an embodiment, a plurality of luminescent balls 36 can be contained in a compartment formed by a clear luminescent light chamber 12 surrounded by light source 9. Fill opening 2 allows the plurality of luminescent balls 36 to be inserted into clear luminescent light chamber 12. A rotating auger 35 rotated by drive shaft 7 transports the luminescent balls 36 from clear luminescent light chamber 12 out of ball ejection exit point 17. The rotating auger 35 also includes ball bump 8.

Figure 24:
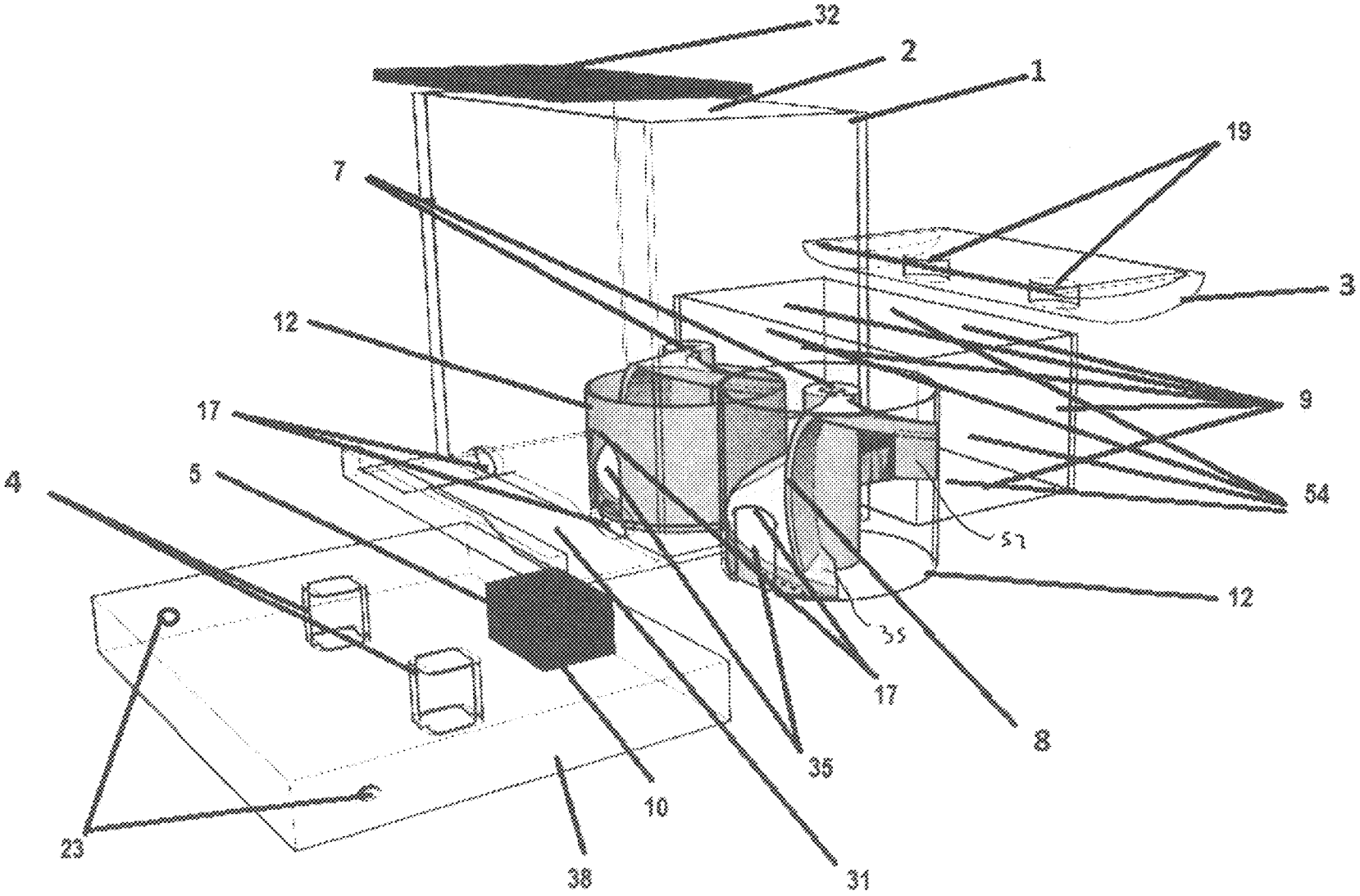
FIG. 24 depicts an exploded view of an embodiment of a large hopper that incorporates a vertical auger-feed and light charging mechanism, according to a preferred embodiment of the present inventions.

FIG. 24 depicts an exploded view of an embodiment of a large hopper holding luminescent balls 36 incorporating a vertical auger-feed and light charging mechanism. The outer wall of a housing 1 forms a storage hopper for holding a large plurality of luminescent balls 36. A fill opening 3 at the top of the housing 1, which can be closed off by a lid assembly 32. A hopper tray 3 can route the number of luminescent balls 36 in housing 1 into light sources 9, with an upper guide ball injection plate 19 guiding the luminescent balls 36 into clear luminescent light chambers 12 to expose light sources 9, which are covered and protected by protection panels 54.

Augers 35 can comprise a clear wall construction that allows illumination by light sources 9 and protective panels 54, which can form a light charging panel surrounding the augers 35 to illuminate and light all of the luminescent balls 36 entering into auger tube 57. Luminescent balls 36 move into augers 35 laterally through auger tube 57. As augers 35 rotate, ball bump 8 interacts with luminescent balls 36 to facilitate passage through the auger fed light charging system and out from ball ejection exit point 17.

Figure 25:
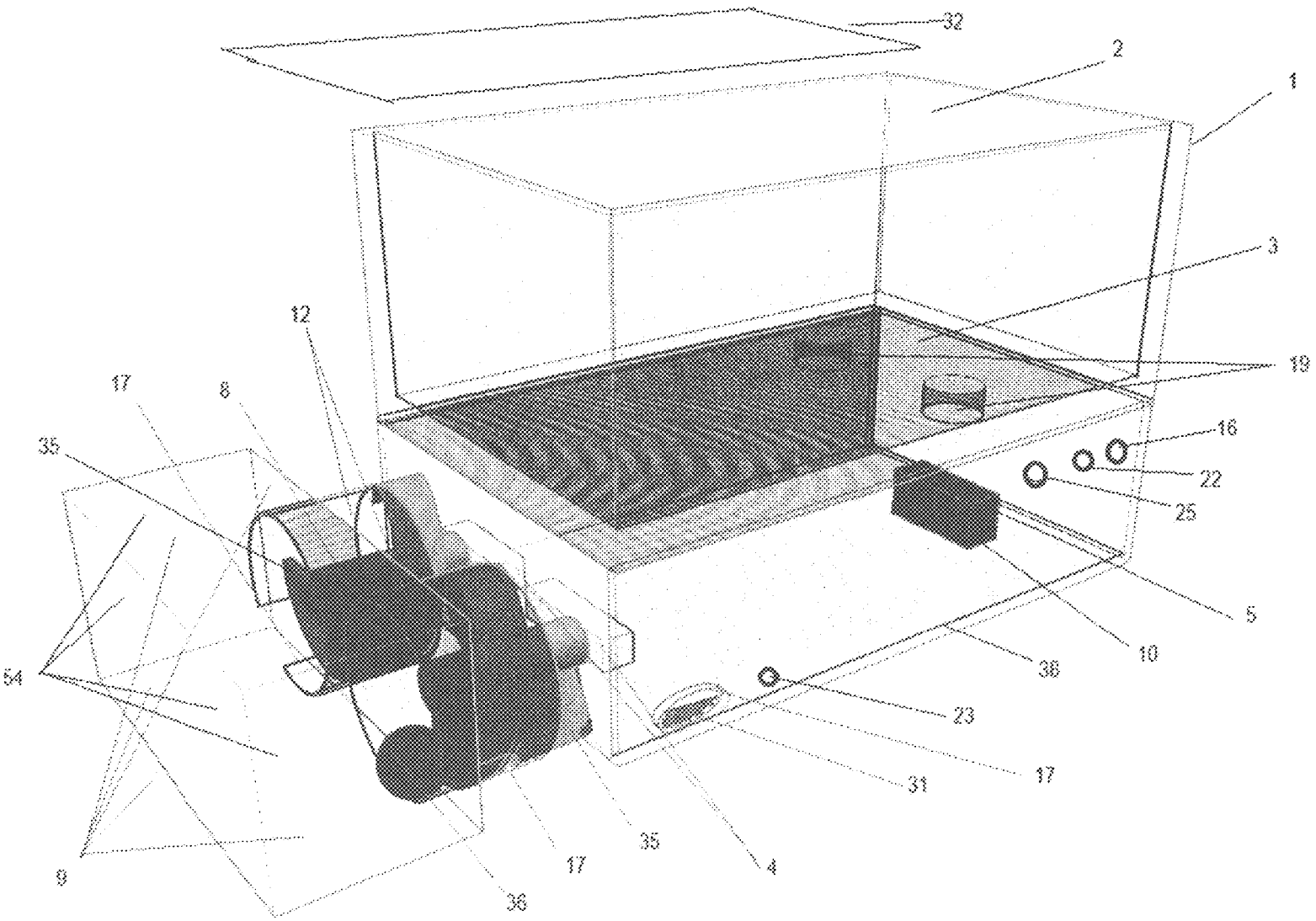
FIG. 25 depicts an exploded view of an embodiment of a large hopper that incorporates a horizontal auger-feed and light charging mechanism, according to a preferred embodiment of the present inventions.

FIG. 25 depicts an exploded view of an embodiment of a large hopper holding luminescent balls 36 incorporating a horizontal auger-feed and light charging mechanism. Housing 1 forms a large internal hopper that can hold a large number of luminescent balls 36 (e.g., 1000). The top of housing 1 includes fill opening 2, which can be closed using lid assembly 32.

Hopper tray 3 positioned inside housing 1 can be mounted using upper guide ball injection plate 19 so as to help guide luminescent balls 36 toward augers 35. Base equipment holding base 38 can include electronic housing 5 to include rechargeable/replaceable batteries 10, and can be connected with on/off switch 16, power port 22, motor control switch 25, and trigger sensor 23. Base equipment holding base 38 can further include a ball ejection exit point 17 with adjustable angle plate 31 guiding luminescent balls 36 out of base equipment holding base 38.

The entire mechanism can be mounted on a base equipment holding base 38 which includes electronic housing 5 and rechargeable batteries 10. Electric motors 4 power augers 35, and trigger sensors 23 controlling motors 4 to effect semiautomatic or full-automatic operation. The luminescent balls 36 can leave their individual auger tube 57 systems to be ejected to players on each side of the light charging machine in a two-direction out-feed configuration. The system allows for timed ejections for contests, a set number of luminescent balls 36 ejected, or single ball on-demand ejection.

Motors 4 power augers 35. Augers 35 are positioned horizontally relative to housing 1. Augers 35 include ball bump 8 and clear luminescent light chambers 12, which are illuminated by light sources 9 protected by protection panels 54 which also function as illuminated charging panels.

In operation, luminescent balls 36 are fed into augers 35 whose clear-wall construction allows the illuminated charging panels formed by protection panels 54 surrounding the augers 35 to light all the luminescent balls 36 in the illuminated auger tube system or assembly to charge the luminescent balls 36 to their full extent. The luminescent balls 36 leave their individual auger tube systems to be ejected to players on either side of the light-charging machine, allowing two directions of out-feed. The system is capable of being fully-automated to semi-automatic. This allows for ejections of timed ejections for contests, of a set quantity of luminescent balls 36, or to allow for single luminescent ball 36 ejection.

Figure 26:
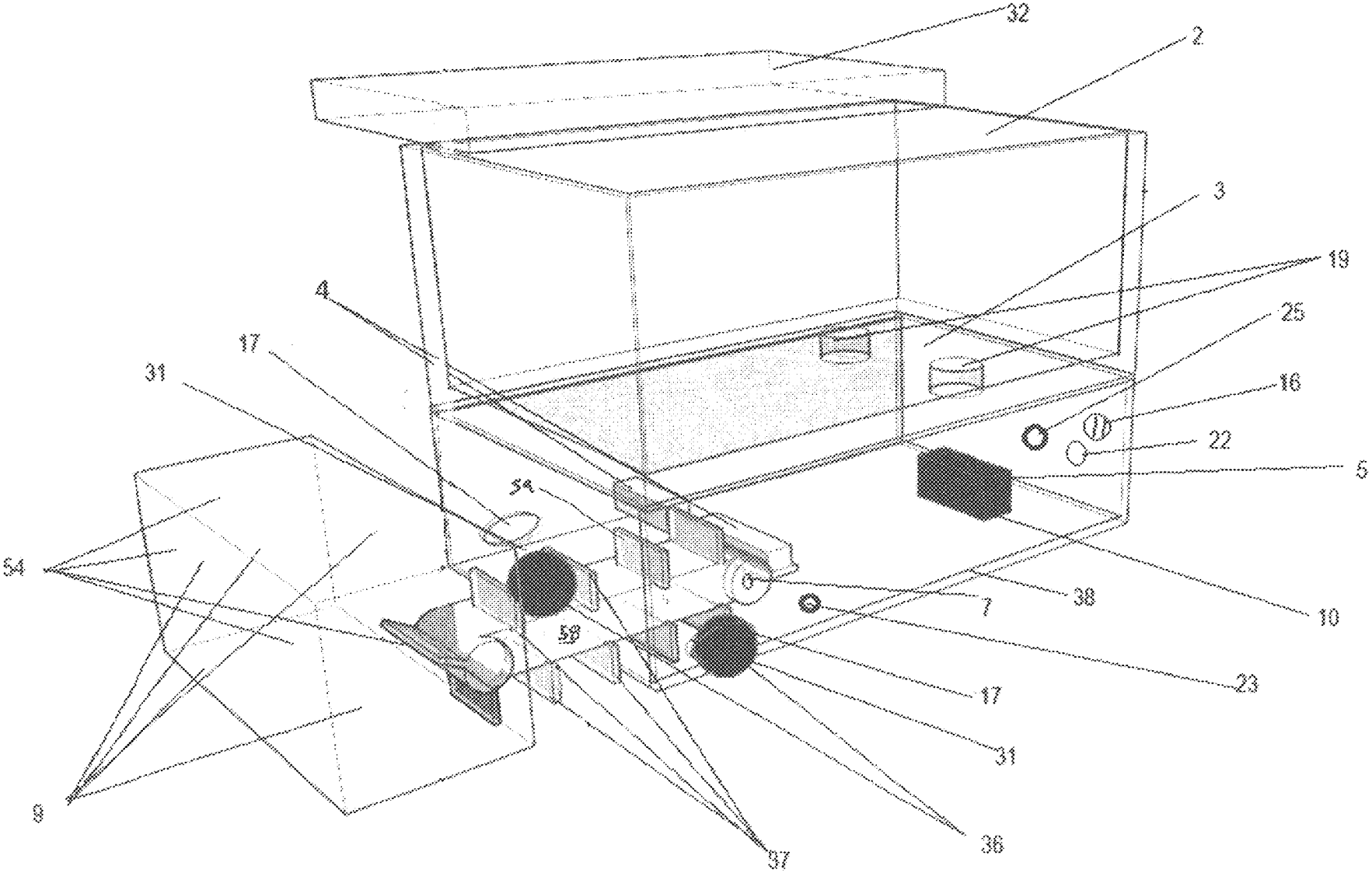
FIG. 26 depicts an exploded view of an alternate embodiment of a large hopper that incorporates a horizontal belt-feed and light charging mechanism, according to a preferred embodiment of the present inventions.

FIG. 26 depicts an exploded view of an alternate embodiment of a large hopper holding luminescent balls 36 incorporating a horizontal belt-fed feed and light charging mechanism. Housing 1 forms a large internal hopper that can hold a large number of luminescent balls 36 (e.g., 1000). The top of housing 1 includes fill opening 2, which can be closed using lid assembly 32.

Hopper tray 3 positioned inside housing 1 can be mounted using upper guide ball injection plate 19 so as to help guide luminescent balls 36 toward the belt-feed 58. Base equipment holding base 38 can include electronic housing 5 to include rechargeable/replaceable batteries 10, and can be connected with on/off switch 16, power port 22, motor control switch 25, and trigger sensor 23. Base equipment holding base 38 can further include a ball ejection exit point 17 with adjustable angle plate 31 guiding luminescent balls 36 out of base equipment holding base 38.

The entire mechanism can be mounted on a base equipment holding base 38 which includes electronic housing 5 and rechargeable batteries 10. Electric motors 4 power belt-feed 58, and trigger sensors 23 controlling motors 4 to effect semiautomatic or fully automatic operation. The luminescent balls 36 can leave their individual clear tractor belt assemblies 37 to be ejected to players on each side of the light charging machine in a two-direction out-feed configuration. The system allows for timed ejections for contests, a set number of luminescent balls 36 ejected, or single ball on-demand ejection.

Motors 4 power belt-feed 58. Belt-feed 58 is positioned horizontally relative to housing 1. Belt-feed 58 includes vertical paddles 59 to facilitate forcing and trapping a luminescent ball 36 to move using belt-feed 59. Alternate embodiments can use alternate mechanisms such as individual mounted cups or containers sized to receive and hold one luminescent ball 36 on belt-feed 58. Belt-feed 58 together with vertical paddles 59 can be made from clear transparent or translucent materials to form clear tractor belt assemblies 37 to transport luminescent balls 36 for illumination by light sources 9 protected by protection panels 54, which also function as illuminated charging panels.

In operation, luminescent balls 36 are fed into the clear tractor belt assemblies 37 whose clear-wall construction allows the illuminated charging panels formed by protection panels 54 surrounding the clear tractor belt assemblies 37 to light all the luminescent balls 36 in the illuminated belt-feed system or assembly to charge the luminescent balls 36 to their full extent. The luminescent balls 36 leave their individual clear tractor belt assemblies 37 to be ejected to players on either side of the light-charging machine, allowing two directions of out-feed. The system is capable of being fully-automated to semi-automatic. This allows for ejections of timed ejections for contests, a set quantity of luminescent balls 36, or to allow for single luminescent ball 36 ejection.

Note, that although only one belt-feed 58 is depicted, a plurality of belt-feeds 58 (or augers 35) can be arranged side-by-side on base equipment holding base 38.

Insofar as the description above and the accompanying drawing disclose any additional subject matter that is not within the scope of the single claim below, the inventions are not dedicated to the public and the right to the one or more applications to claim such additional inventions is reserved.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The foregoing has described methods and systems for a luminescent ball light charging mechanism that are given for illustration and not for limitation and uses. Thus, the inventions are limited only by the appended claims. Although the inventions have been described in accordance with the embodiments shown, one of ordinary skill in the art will readily recognize that there could be variations to the embodiments and those variations would be within the spirit and scope of the present inventions. Accordingly, many modifications may be made by one of ordinary skill in the art without departing from the spirit and scope of the appended claims.

Particular terminology used when describing certain features or aspects of the embodiments should not be taken to imply that the terminology is being redefined herein to be restricted to any specific characteristics, features, or aspects with which that terminology is associated. In general, the terms used in the following claims should not be construed to be limited to the specific embodiments disclosed in the specification, unless the above Detailed Description section explicitly defines such terms. Accordingly, the actual scope of the claims encompasses not only the disclosed embodiments, but also all equivalent ways of practicing or implementing the claimed subject matter.

The above detailed description of the embodiments is not intended to be exhaustive or to limit the disclosure to the precise embodiment or form disclosed herein or to the particular fields of usage mentioned above. While specific embodiments and examples are described above for illustrative purposes, various equivalent modifications are possible within the scope of the disclosure, as those skilled in the relevant art will recognize. Also, the teachings of the embodiments provided herein can be applied to other systems, not necessarily the system described above. The elements and acts of the various embodiments described above can be combined to provide further embodiments.

Any patents, applications and other references that may be listed in accompanying or subsequent filing papers, are incorporated herein by reference. Aspects of embodiments can be modified, if necessary, to employ the systems, functions, and concepts of the various references to provide yet further embodiments.

In light of the above "Detailed Description," the Inventor may make changes to the disclosure. While the detailed description outlines possible embodiments and discloses the best mode contemplated, no matter how detailed the above appears in text, embodiments may be practiced in a myriad of ways. Thus, implementation details may vary considerably while still being encompassed by the spirit of the embodiments as disclosed by the inventor. As discussed herein, specific terminology used when describing certain features or aspects should not be taken to imply that the terminology is being redefined herein to be restricted to any specific characteristics, features, or aspects of the embodiments with which that terminology is associated.

While certain aspects are presented below in certain claim forms, the inventor contemplates the various aspects in any number of claim forms. Accordingly, the inventor reserves the right to add additional claims after filing the application to pursue such additional claim forms for other aspects.

The above specification, examples and data provide a description of the structure and use of exemplary implementations of the described systems, articles of manufacture and methods. It is important to note that many implementations can be made without departing from the spirit and scope of the disclosure.

Modifications and Variations

As will be recognized by those skilled in the art, the innovative concepts described in the present application can be modified and varied over a tremendous range of applications, and accordingly the scope of patented subject matter is not limited by any of the specific exemplary teachings given. It is intended to embrace all such alternatives, modifications and variations that fall within the spirit and broad scope of the appended claims.

Various types of light sources can be employed such as LEDs, conventional light bulbs, fluorescent tubes, or the like, with a transparent or translucent panel employed as a light diffuser to create a light panel.

The housing 1 can be constructed from a variety of materials including wood, plastic, light weight metal, or sheet metal. In some embodiments, a hopper and light chamber can be installed into a fixed structure such as a small outbuilding, shed, or cement/masonry cabinet or the like (i.e., a housing 1).

The disclosed embodiments can be configured for various types of balls such as baseballs, footballs, softballs, basketball tennis balls, and the like.

A hand crank or a ratchet arm can be substituted for the electric motor to manually operate the transport assembly.

A solar power cell or cell array can be used as a charging unit to charge the batteries during the day to provide power at night.

None of the description in the present application should be read as implying that any particular element, step, or function is an essential element which must be included in the claim scope: THE SCOPE OF PATENTED SUBJECT MATTER IS DEFINED ONLY BY THE ALLOWED CLAIMS. Moreover, none of these claims are intended to invoke paragraph six of 35 USC section 112 unless the exact words "means for" are followed by a participle.

The claims as filed are intended to be as comprehensive as possible, and NO subject matter is intentionally relinquished, dedicated, or abandoned.

What is claimed is:

1. A light charging system for charging a plurality of luminescent objects to cause said objects to emit light, comprising:

a housing subdivided into a hopper section, a transport and light charging section, and a base section;

the housing further comprises a lid assembly for sealing the hopper and providing a light proof enclosure;

the transport and light charging section further comprises a transport assembly integrated with a light charging assembly, with the transport assembly configured to receive and transport at least one luminescent object from the hopper into and through the light charging assembly, which comprises a lighting source;

the lighting source comprising an illuminating light panel interposed between at least one light source and the at least one luminescent object when operating; and the base section comprises an ejection exit point for the at least one luminescent object to exit the light charging assembly;

wherein the transport assembly further comprises a first pair of rotating plates and a second pair of fixed plates, with one each of the first pair of rotating plates and the second pair of fixed plates positioned adjacent to each other, and as the first pair of rotating plates rotate, portals in each adjacent plate align to move the at least one luminescent object between adjacent plates to move into and out of the light charging assembly.

2. The light charging system for charging a plurality of luminescent objects to cause said objects to emit light of claim 1, wherein the transport assembly comprises at least one of a plurality of rotating and fixed vertically aligned plates, a vertical auger, a horizontal auger, or a tractor belt.

3. The light charging system for charging a plurality of luminescent objects to cause said objects to emit light of claim 1, wherein the at least one light source of the light charging assembly comprises of an array of LEDs with light from the LEDs passing through a diffuser material to create the illuminating light panel.

4. The light charging system for charging a plurality of luminescent objects to cause said objects to emit light of claim 1, wherein the at least one light source comprises a spiral tube formed into a cylinder with light from the spiral tube passing through a diffuser material formed as a cylinder to provide the illuminating light panel, with the spiral tube configured into an open top and bottom cylinder, and the open top and bottom functioning as a portal to facilitate passage of the luminescent object into and out of the light charging.

5. The light charging system for charging a plurality of luminescent objects to cause said objects to emit light of claim 1, wherein the transport assembly comprises a tractor belt with vertical paddles receiving the at least one luminescent object with the tractor belt moving the at least one luminescent object into and/or out of the light charging assembly.

6. The light charging system for charging a plurality of luminescent objects to cause said objects to emit light of claim 1, wherein the transport assembly comprises an auger vertically positioned below the hopper and receives and vertically moves the at least one luminescent object into and/or out of the light charging assembly.

7. The light charging system for charging a plurality of luminescent objects to cause said objects to emit light of claim 1, wherein the transport assembly comprises an auger horizontally positioned adjacent to the hopper and receives and horizontally moves the at least one luminescent object into and/or out of the light charging assembly.

8. The light charging system for charging a plurality of luminescent objects to cause said objects to emit light of claim 1, further comprising:

an electronic housing comprised of at least one battery, a micro-controller for implementing a mode of operation, a motor to power the transport assembly, an on/off switch, and a wiring connection to a trigger sensor for activating the motor and/or eject the luminescent object; and the trigger sensor when activated moves the at least one luminescent object from the hopper into the transport assembly and ejects at least one charged luminescent object.

9. The light charging system for charging a plurality of luminescent objects to cause said objects to emit light of claim 1, wherein a mode of operation can include at least one of— a. automatic whereby the system ejects luminescent objects at preset time intervals;

b. automatic whereby the system ejects a set number of luminescent objects at a single time or over a set time period;

c. semi-automatic whereby the system ejects a set number of luminescent objects in response to a trigger sensor input;

d. semi-automatic whereby the system ejects a luminescent object at a single time or over a set time period in response to a trigger sensor input;

e. manually whereby the system ejects a luminescent object using a manual input.

10. An apparatus for light charging a plurality of luminescent balls to cause said balls to emit light, comprising:

a hopper section for receiving and storing a plurality of luminescent balls, a luminescent ball transport and light charging section, and a base section, with each section light proofed to prevent light leakage;

the luminescent ball transport and light charging section further comprises a transport assembly integrated with a light charging assembly, with the transport assembly configured to receive and transport at least one luminescent ball from the hopper into and through the light charging assembly, which comprises at least one light panel interposed between at least one light source and the at least one luminescent ball; and the base section comprises at least one signal input device to control an ejection exit point to cause at least one luminescent ball to exit the light charging assembly wherein the transport assembly further comprises a first pair of rotating plates and a second pair of fixed plates, with one each of the first pair of rotating plates and the second pair of fixed plates positioned adjacent to each other, and as the first pair of rotating plates rotate, portals in each adjacent plate align to move the at least one luminescent object between adjacent plates to move into and out of the light charging assembly.

11. The apparatus for light charging a plurality of luminescent balls to cause said balls to emit light of claim 10, wherein the transport assembly comprises at least one of a plurality of rotating and fixed vertically aligned plates, a vertical auger, a horizontal auger, or a tractor belt.

12. The apparatus for light charging a plurality of luminescent balls to cause said balls to emit light of claim 10, wherein the at least one light panel comprises at least one light source with light passing through a diffuser material to create the light panel; and said light panel further protects the at least one light source.

13. The apparatus for light charging a plurality of luminescent balls to cause said balls to emit light of claim 10, wherein the light assembly comprises a cylinder with the light panel configured as an open top and bottom cylinder, and the open top and bottom functioning as a portal to facilitate passage of the luminescent ball into and out of the light charging assembly.

14. The apparatus for light charging a plurality of luminescent balls to cause said balls to emit light of claim 10, further comprising:

an electrical circuit comprised of at least one battery, a micro-controller for implementing a mode of operation, a motor to power the transport assembly, an on/off switch, and a trigger sensor for activating the motor and/or eject the luminescent ball.

15. The apparatus for light charging a plurality of luminescent balls to cause said balls to emit light of claim 14, wherein the mode of operation can include at least one of— a. automatic whereby the apparatus ejects luminescent balls at preset time intervals;

b. automatic whereby the apparatus ejects a set number of luminescent balls at a single time or over a set time period;

c. semi-automatic whereby the apparatus ejects a set number of luminescent balls in response to a trigger sensor input; and d. semi-automatic whereby the apparatus ejects one luminescent ball at a single time or over a set time period in response to a trigger sensor input.

16. A device for charging a luminescent ball, comprising:

a receiving and storing section for a luminescent ball, a transport and light charging section, and an ejection section;

the transport and light charging section comprising a transport assembly integrated with a light charging assembly, with the transport assembly configured to receive and transport the luminescent ball from the receiving and storing section into and through the light charging assembly, which comprises a light source, and into the ejection section, and wherein the transport assembly further comprises a first pair of rotating plates and a second pair of fixed plates, with one each of the first pair of rotating plates and the second pair of fixed plates positioned adjacent to each other, and as the first pair of rotating plates rotate, portals in each adjacent plate align to move the at least one luminescent object between adjacent plates to move into and out of the light charging assembly;

the luminescent ball once light charged ejected from the ejection section; and the luminescent ball transport and light charging section and ejection section controlled using a microcontroller and sensor electric circuit to implement at least one of the following modes of operation— a. automatic whereby the device ejects luminescent balls at preset time intervals;

b. automatic whereby the device ejects a set number of luminescent balls at a single time and/or over a set time period;

c. semi-automatic whereby the device ejects a set number of luminescent balls in response to a sensor input; and d. semi-automatic whereby the device ejects one luminescent ball at a single time and/or over a set time period in response to a sensor input.

17. The device for charging a luminescent ball, of claim 16, wherein the transport assembly comprises at least one of a plurality of rotating and fixed vertically aligned plates, a vertical auger, a horizontal auger, or a tractor belt.

18. The device for charging a luminescent ball, of claim 16, wherein the light source comprises a light panel.

19. The device for charging a luminescent ball, of claim 16, wherein the light source comprises an LED.

* * * * *